US005509576A

United States Patent [19]

Weinheimer et al.

[11] Patent Number: 5,509,576

[45] Date of Patent: Apr. 23, 1996

[54] ELECTRIC AUTOINFLATOR

[75] Inventors: Jacek M. Weinheimer, Treasure Island; Michael T. Taylor, St. Petersburg, both of Fla.; Richard A. Boe, Fairfax, Va.

[73] Assignee: Halkey-Roberts Corporation, St. Petersburg, Fla.

[21] Appl. No.: 77,303

[22] Filed: Jun. 14, 1993

Related U.S. Application Data

[63] Continuation-in-part of Ser. No. 914,382, Jul. 14, 1992, Pat. No. 5,400,922.

[51] Int. Cl.[6] ..... B67B 7/00

[52] U.S. Cl. ..... 222/5; 222/52; 222/192; 441/93

[58] Field of Search ..... 222/5, 6, 52, 54, 222/191, 192; 441/93, 94, 95, 101

[56] References Cited

U.S. PATENT DOCUMENTS

| | | | |
|---|---|---|---|
| 3,008,479 | 11/1961 | Mancusi, Jr. | 137/68 |
| 3,059,814 | 10/1962 | Poncel et al. | 222/5 |
| 3,091,782 | 6/1963 | Sclafani | 9/316 |
| 3,180,524 | 4/1965 | Shepard et al. | 222/5 |
| 3,426,942 | 2/1969 | McMains et al. | 222/5 |
| 3,526,339 | 9/1970 | Bernhardt et al. | 222/5 |
| 3,579,964 | 5/1971 | Ohlstein | 222/5 |
| 3,597,780 | 8/1971 | Coyle | 222/5 X |
| 3,625,178 | 12/1971 | Pracher | 116/114 |
| 3,702,014 | 11/1972 | Rabon et al. | 9/8 |
| 3,757,371 | 9/1973 | Martin | 9/316 |
| 3,809,288 | 4/1974 | Mackal | 222/5 |
| 3,910,457 | 10/1975 | Sutliff et al. | 222/5 |
| 3,997,079 | 12/1976 | Niemann | 222/5 |
| 4,024,440 | 5/1977 | Miller | 441/94 X |
| 4,046,157 | 9/1977 | Cazalaa et al. | 137/74 |
| 4,223,805 | 9/1980 | Mackal | 222/5 |
| 4,260,075 | 4/1981 | Mackal | 222/5 |
| 4,267,944 | 5/1981 | Mackal | 222/5 |
| 4,356,936 | 11/1982 | Legris | 222/5 |
| 4,382,231 | 5/1983 | Miller | 324/439 |
| 4,416,393 | 11/1983 | Zimmerly | 222/5 |
| 4,436,159 | 3/1984 | Revay | 169/28 |
| 4,493,664 | 1/1985 | Dale | 441/7 |
| 4,500,014 | 2/1985 | Zimmerly | 222/5 |
| 4,513,248 | 4/1985 | Miller | 324/439 |
| 4,714,914 | 12/1987 | Boe | 340/573 |
| 4,805,802 | 2/1989 | MacKendrick | 222/5 |
| 4,906,962 | 3/1990 | Duimstra | 337/239 |
| 4,927,057 | 5/1990 | Janko et al. | 222/5 |
| 4,972,971 | 11/1990 | Janko et al. | 222/5 |
| 5,026,310 | 6/1991 | Mackal et al. | 441/93 |
| 5,035,345 | 7/1991 | Janko et al. | 222/5 |
| 5,076,468 | 12/1991 | Mackal | 222/5 |

FOREIGN PATENT DOCUMENTS

| | | | |
|---|---|---|---|
| 2334859 | 7/1977 | France . | |
| 2185304 | 7/1987 | United Kingdom | 441/93 |
| 8204232 | 12/1982 | WIPO | 441/95 |

*Primary Examiner*—Andres Kashnikow
*Attorney, Agent, or Firm*—Dominik & Stein

[57] ABSTRACT

An autoinflator for automatically actuating a gas cartridge upon sensing of water. The autoinflator includes a fusible link actuator assembly positioned within a longitudinal bore. The fusible link assembly includes an actuator housing with a blind link hole, an actuator cap, and a pair of retaining balls protruding from the sides of said actuator housing which engage into a corresponding slot in the longitudinal bore to retain the actuator housing in a cocked position. A slidable link, positioned within the blind link hole, includes an annular groove positioned about its circumference at a rearward portion thereof and a taper positioned at a forward position thereof. A fusible link interconnects the actuator cap and the slidable link for retaining the slidable link rearwardly in a cocked position within the blind link hole. Upon being supplied electrical current when submersion in water is sensed, the fusible link is melted, and the retaining balls engage into the annular groove of the slidable link thereby causing actuation of the gas cartridge.

32 Claims, 26 Drawing Sheets

ELECTRIC AUTOINFLATOR

CROSS-REFERENCE TO RELATED APPLICATION

This application is a continuation-in-part application of Ser. No. 07/914,382, filed Jul. 14, 1992, now U.S. Pat. No. 5,400,922.

BACKGROUND OF THE INVENTION

1. Field of the Invention

This invention relates to electric autoinflators for inflating inflatable articles such as personal floatation devices, rafts, buoys and emergency signalling equipment. More particularly, this invention relates to electric autoinflators which are actuated upon being immersed in water for a predetermined delay period.

2. Description of the Background Art

Presently there exists many types of inflators designed to inflate inflatable articles such as personal floatation devices (life vests, rings and horseshoes), life rafts, buoys and emergency signalling equipment. These inflators typically comprise a body for receiving the neck of a cartridge of a compressed gas such as carbon dioxide. A reciprocating firing pin is disposed within the body for piercing the frangible seal of the cartridge to permit the compressed gas therein to flow into a manifold in the body and then into the device to be inflated. Typically, a manually-movable firing lever is operatively connected to the firing pin such that the firing pin pierces the frangible seal of the cartridge upon manual movement of the same. U.S. Pat. No. 3,809,288, the disclosure of which is hereby incorporated by reference herein, illustrates one particular embodiment of the manual inflator.

While these manual inflators work suitably well, it was quickly learned that in an emergency situation, the person needing the assistance of the inflatable device, such as a downed aviator, injured person, child, or a man overboard, would fail or be unable to manually actuate the inflator. In other applications, such as sonobuoys, automatic actuation is imperative. Accordingly, it was realized that a means must be provided for automatically actuating the inflator in such situations and applications.

In response to this need, water-activated automatic inflators have been developed which, when exposed to a fluid such as water, automatically actuate the firing pin of the inflator causing inflation of the inflatable device.

One type of water-activated automatic inflator comprises a water-activated trigger assembly including a water destructible or dissolvable element which retains a spring-loaded actuator pin in a cocked position in alignment with the firing pin. Upon immersion in water causing the element to destruct or dissolve, the spring-loaded actuator pin is released to forcibly move from the cocked position to an actuated position to strike the firing pin, either directly or indirectly by means of an intermediate transfer pin. Upon striking the firing pin, the pin fractures the seal of the cartridge thereby allowing the gas contained therein to flow into the inflatable device to inflate the same. U.S. Pat. Nos. 3,997,079; 4,223,805; 4,267,944; 4,260,075; and 4,627,823, the disclosures of each of which are hereby incorporated by reference herein, illustrate several examples of water-activated automatic inflators which employ a dissolvable element.

While the above automatic inflators work quite well to automatically inflate the inflatable device in the event of an emergency situation or other application, one major disadvantage to these automatic inflators is their tendency to self-actuate while stored for subsequent exigent use. Specifically, it is not uncommon for the automatic inflator to be stored in a highly humid environment such as on a ship or on a boat. Over a period of time, the moisture contained within the humid air is absorbed by the water dissolvable element to such a degree that the element is weakened, particularly since the element is continually subjected to the force of the actuator spring. As the element gradually weakens, the strength of the element eventually becomes insufficient to retain the spring-loaded actuator pin in the cocked position. The element then collapses under the force of the compressed spring of the actuator pin and the actuator pin strikes the firing pin thereby causing premature and unintentional inflation of the inflatable device.

The problem of premature and unintentional actuation of the automatic inflator is so acute that it is not uncommon for a weakened water destructible or dissolvable element to be replaced with a new element on a periodic basis pursuant to a regularly scheduled maintenance plan. In this regard, it is noted that each of the prior art water-activated automatic inflators disclosed in the above referenced patents teach a structure which may be easily disassembled to facilitate removal of a weakened element and the installation of a new one. Indeed, U.S. Pat. No. 4,627,823 discloses a safety-latched automatic actuator designed to release the pressure exerted on the water-dissolvable element until such time as an emergency situation exists.

Another type of a water-activated automatic inflator comprises a water-activated, squib-powered inflator. As the term is commonly used, a squib is a self-contained explosive charge. Upon actuation by electric current, the explosive charge explodes to actuate the inflator. U.S. Pat. Nos. 3,059,814; 3,091,782; 3,426,942; 3,579,964; 3,702,014; 3,757,371; 3,910,457; 4,382,231; 4,436,159; 4,513,248; 5,026,310; and 5,076,468, the disclosures of each are hereby incorporated by reference herein, illustrate several examples of water-activated squib-powered inflators.

A still other type of water-activated automatic inflator comprises a fusible link assembly which retains a spring-loaded actuator pin in a cocked position in alignment with the firing pin, either directly or indirectly by means of an intermediate transfer pin. Upon exposure to water, electrical current is supplied to a heater wire, wrapped around the fusible link. Upon melting of the fusible link, the actuator pin strikes the firing pin to fracture the seal of the cartridge thereby allowing the gas contained therein to flow into the inflatable device to inflate the same. See generally, U.S. Pat. No. 3,008,479.

It is noted that in both the squib-powered and the fusible link inflators noted above, water-sensing circuitry is provided for sensing the presence of water. In this regard, prior art circuitry is illustrated in U.S. Pat. No. 5,026,310 noted above, and in U.S. Pat. No. 4,714,914, the disclosure of which is incorporated by reference herein. More particularly, the circuitry disclosed in the last mentioned patent above, includes a delay feature which causes actuation only upon being immersed in water (or other liquid) for a predetermined period of time, such as for five seconds. In this manner, unintended actuation is prevented in the event that the sensing circuitry is merely splashed with water.

There exists a continuing need for improved inflators that operate more reliably when immersed in water and which, after firing causing inflation of the inflatable device, may be easily disassembled so as to install a new firing mechanism and a new gas cartridge.

Therefore, it is an object of this invention to provide an apparatus which overcomes the aforementioned inadequacies of the prior art autoinflators and provides an improvement which is a significant contribution to the advancement of the autoinflator art.

Another object of this invention is to provide a fusible link actuator assembly positioned within the longitudinal bore of an autoinflator body and including an actuator housing including a blind link hole defining an opened rearward end, an actuator cap positioned over the opened end, and a pair of retaining balls protruding from opposing sides of the actuator housing which engage into corresponding slots in the longitudinal bore to retain the actuator housing in a cocked position, a slidable link positioned within the blind link hole, the slidable link including an annular groove positioned about its circumference at a rearward portion thereof and a blind spring hole opening rearwardly, a compression link spring positioned within the blind spring hole for urging the slidable link forwardly, a fusible link interconnecting the actuator cap and the slidable link for retaining the slidable link rearwardly in a cocked position within the blind link hole, and means for fusing the fusible link upon being supplied electrical current thereto.

Another object of this invention is to provide an ejector lever operatively positioned within the longitudinal bore of an autoinflator having an actuator assembly for ejecting the actuator assembly after firing.

Another object of this invention is to provide a window means positioned in an autoinflator relative to the longitudinal bore to visually indicate when the actuator assembly has been actuated.

Another object of this invention is to provide an autoinflator body including an open-ended battery compartment for containing a battery, a battery compartment cap positioned over the opened-end with one side of the cap farthest from the gas cartridge being pivotably connected to the body and with another side of the cap adjacent to the gas cartridge including a releasible latch for releasable connection to the body, the latch including a slot allowing the latch to be opened with a tool when the gas cartridge is removed from the body.

Another object of this invention is to provide an autoinflator water-sensing circuit for sensing water between a first and a second water-sensing electrode protruding from a surface of the body and separated by protuberance means to hinder the bridging or pooling of water therebetween and causing unintentional actuation of the actuator assembly.

Another object of this invention is to provide an autoinflator water-sensing circuit including an activation timer for timing the duration of water immersion regardless of water conductivity, an activation timer reset for the activation timer to assure uniform water immersion regardless of previous water immersion history, and an activation duration timer for timing the duration of electrical current supplied to the fusing means.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises an electric autoinflator for inflating inflatable devices such as personal floatation devices, life rafts, buoys and emergency signalling equipment. More particularly, the electric autoinflator of the invention comprises an actuator assembly including a fusible link. A water-sensing electrical circuit and battery supplies electrical current to the fusible link actuator assembly upon immersion in water for a predetermined period of time (i.e. 5 seconds). Upon fusing of the link, the actuator assembly forcibly causes a firing pin of the inflator to pierce the frangible seal of a compressed gas cartridge. The escaping gas then inflates the inflatable device.

The autoinflator of the invention comprises a unique construction which results in more reliable operation and greater ergonomics for easier field disassembly and correct reassembly. Specifically, the water-sensing circuit of the autoinflator of the invention includes an indicator to indicate a charged battery and to indicate a fully operational autoinflator. After firing, the circuit indicates the fired condition. The circuit requires removal of the battery after firing, thereby encouraging replacement with a new battery. The circuit may include means for sensing the polarity of the battery, thereby allowing it to be installed without regard to polarity. Furthermore, the cap of the battery compartment is configured so as to require removal of the spent gas cartridge before replacement of the battery, thereby encouraging replacement with a new cartridge. Water-drip protuberances are provided about the water-sensing electrodes so as to encourage water to drip away from the electrodes rather than "bridging" or "pooling" around the electrodes during splashing or momentary immersion of the autoinflator and causing unintended firing.

In one embodiment, an ejector lever is provided for removing a spent fusible link actuator assembly. In another embodiment, the pivotal arm of the manual inflator assembly is configured so as to allow easy removal of the fusible link actuator assembly after firing. In both embodiments, if a new cartridge is installed without having removed the spent fusible link actuator assembly (or without correctly realigning the arm of the manual inflator), the cartridge is fired, thereby indicating that the spent fusible link actuator assembly requires replacement (or, in the other embodiment, that the manual inflator arm requires realignment).

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
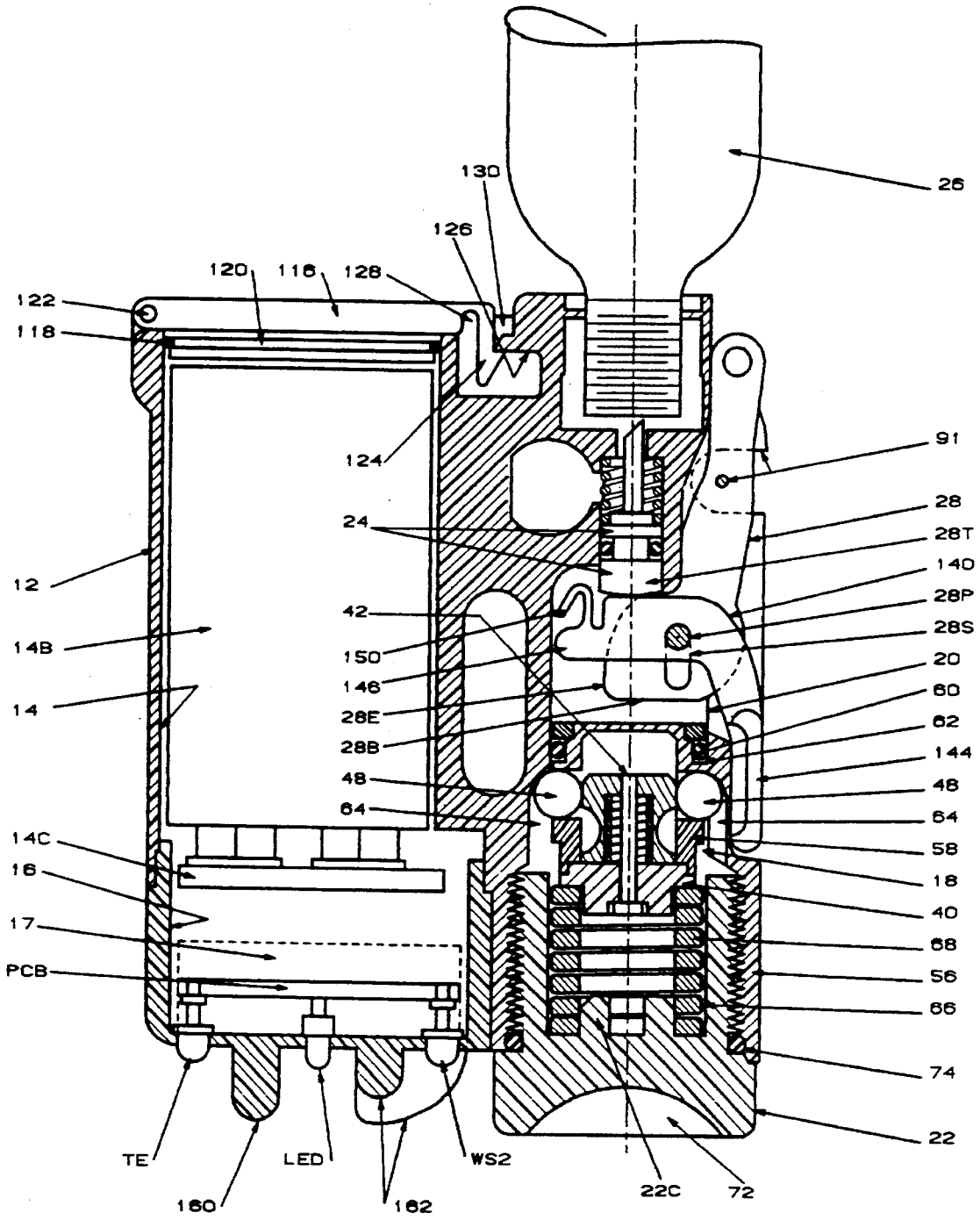
FIG. 1 is a longitudinal cross-sectional view of the electric autoinflator of the invention illustrating the first embodiment of the fusible link actuator assembly in its cocked, non-actuated position ready for firing.

Referring to FIG. 1, the autoinflator 10 of the invention comprises a generally rectilinear body 12 having a battery compartment 14 containing a battery 14B and a printed circuit board compartment 16 containing a printed circuit board PCB. A water-sensing circuit 17 is mounted onto the printed circuit board PCB. A conventional battery connector 14C electrically connects the battery 14B to the circuit 17 for supplying electrical power thereto. A first embodiment of a fusible link actuator assembly 18 is operatively positioned in a cocked position within a longitudinal bore 20 of the body 12 and is enclosed into position by means of its screw cap 22. A pierce/firing pin 24 is also operatively positioned within longitudinal bore 20 in alignment with a gas cartridge 26 to fire the same. A manual firing lever 28 is operatively positioned adjacent the firing pin 24 in the longitudinal bore 20 allowing manual firing of the autoinflator 10.

Fusible Link Actuator Assembly

Figure 1B:
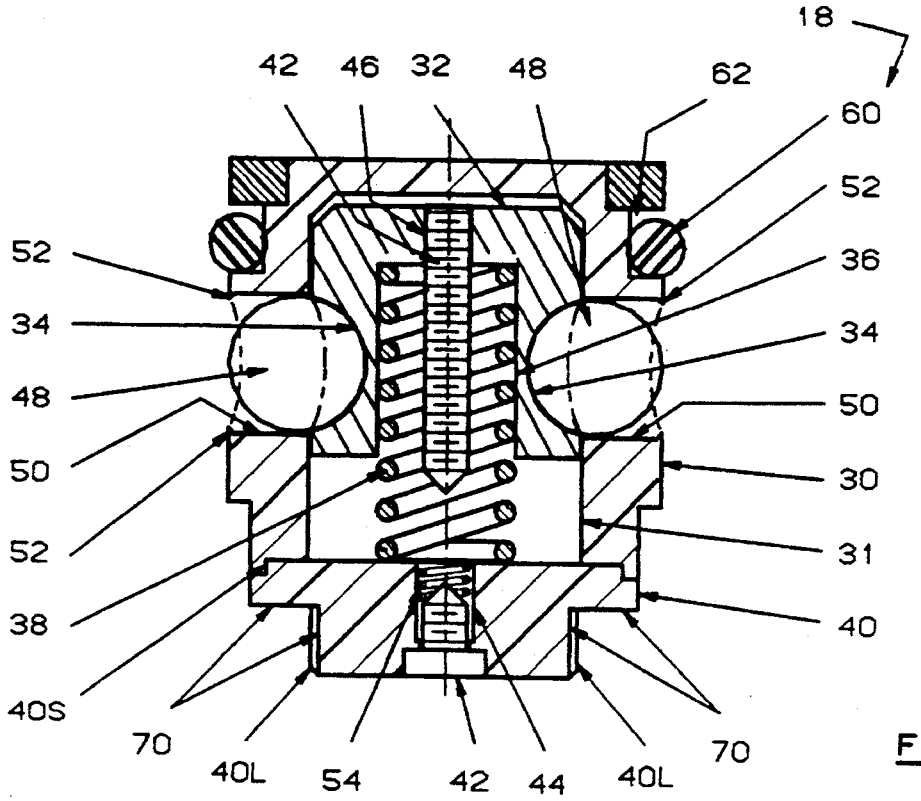
FIG. 1B is an enlarged cross-sectional view of the first embodiment of the fusible link actuator assembly, similar to FIG. 1A, but with the slidable link of the fusible link actuator assembly in its actuated position after firing.
Figure 1A:
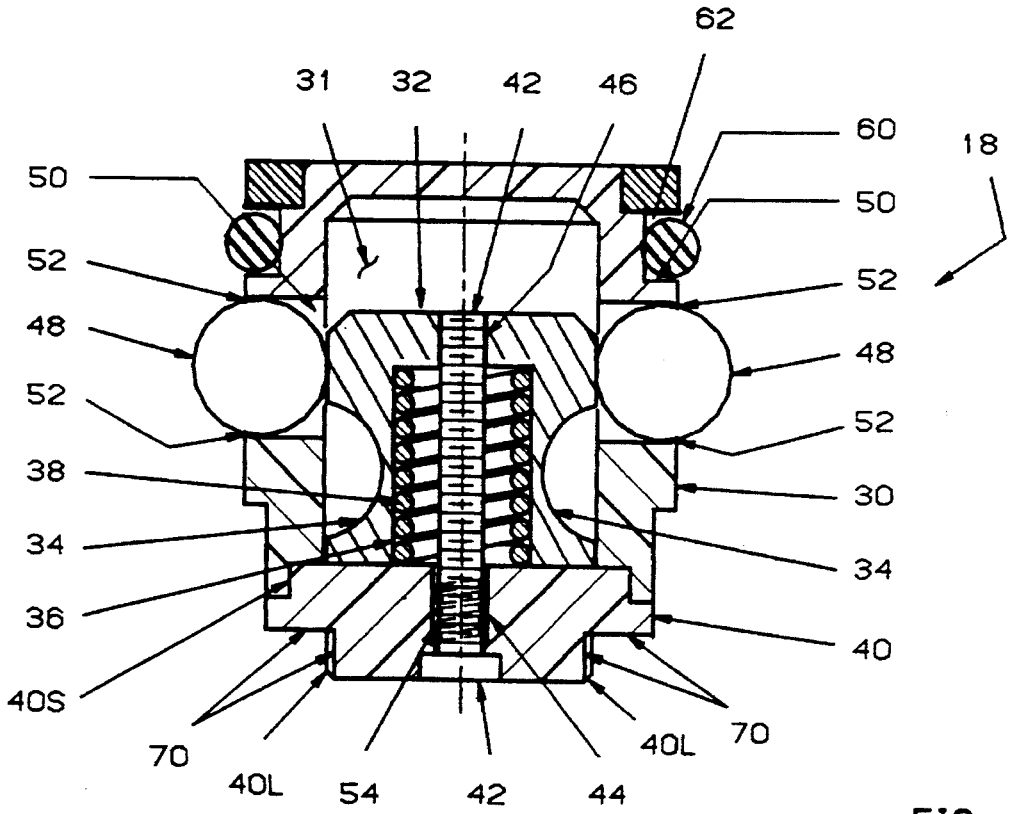
FIG. 1A is an enlarged cross-sectional view of the first embodiment of the fusible link actuator assembly of FIG. 1.
Figure 1C:
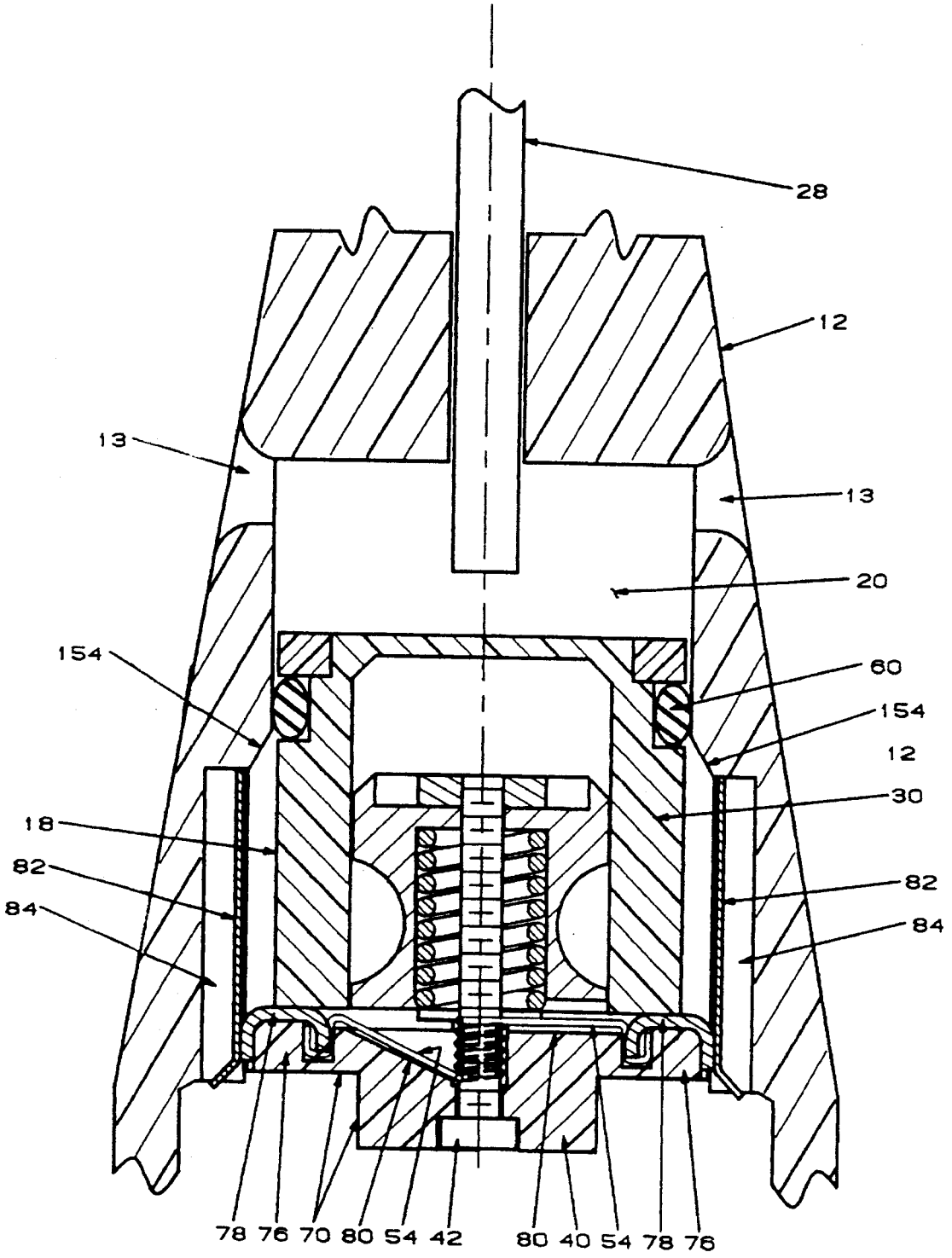
FIG. 1C is a partial enlarged cross-sectional view, taken 90° from FIG. 1, of the first embodiment of the fusible link actuator assembly of the autoinflator positioned within the longitudinal bore illustrating the electrical connection of the fusible link actuator assembly therein.
Figure 1E:
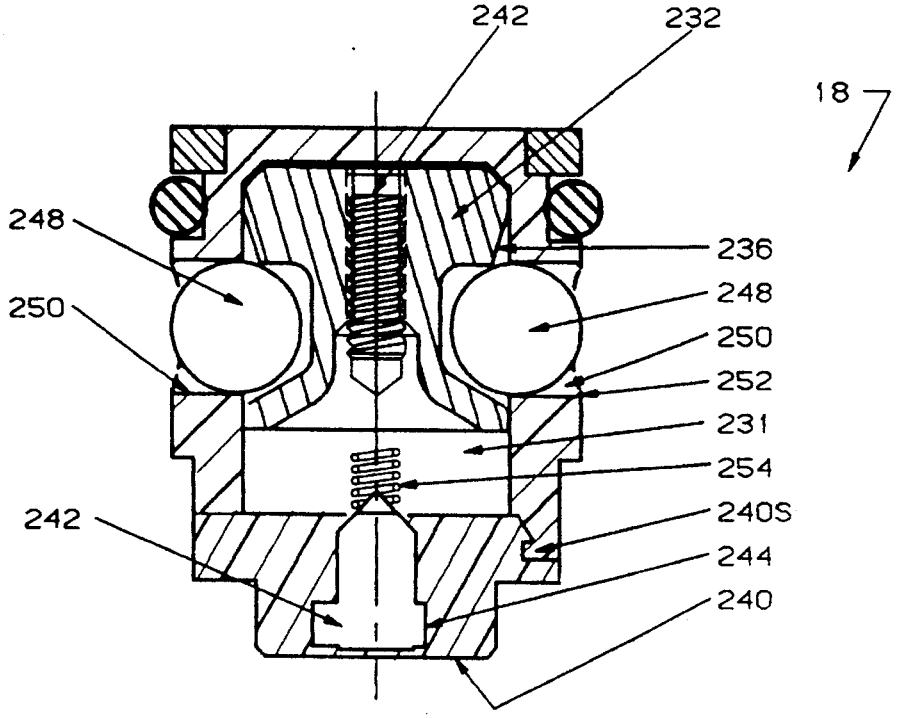
FIG. 1E is an enlarged cross-sectional view of the second embodiment of the fusible link actuator assembly, similar to FIG. 1D, but with the slidable link of the fusible link actuator assembly in its actuated position after firing.
Figure 1D:
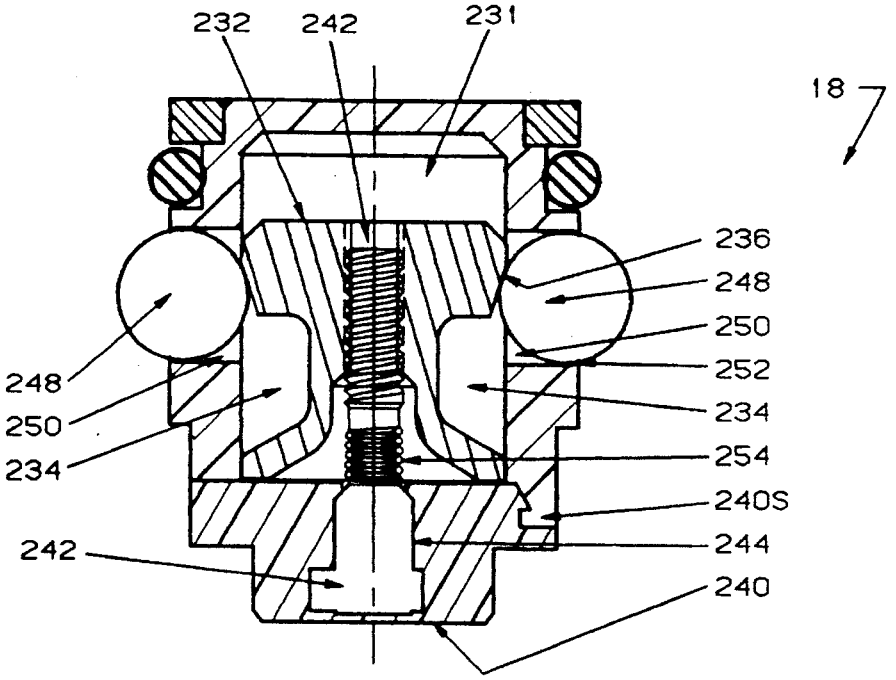
FIG. 1D is an enlarged cross-sectional view of the second embodiment of the fusible link actuator assembly having tapered sides thereby eliminating the need for the compression link spring employed in the first embodiment of the fusible link actuator assembly of FIG. 1.
Figure 1F:
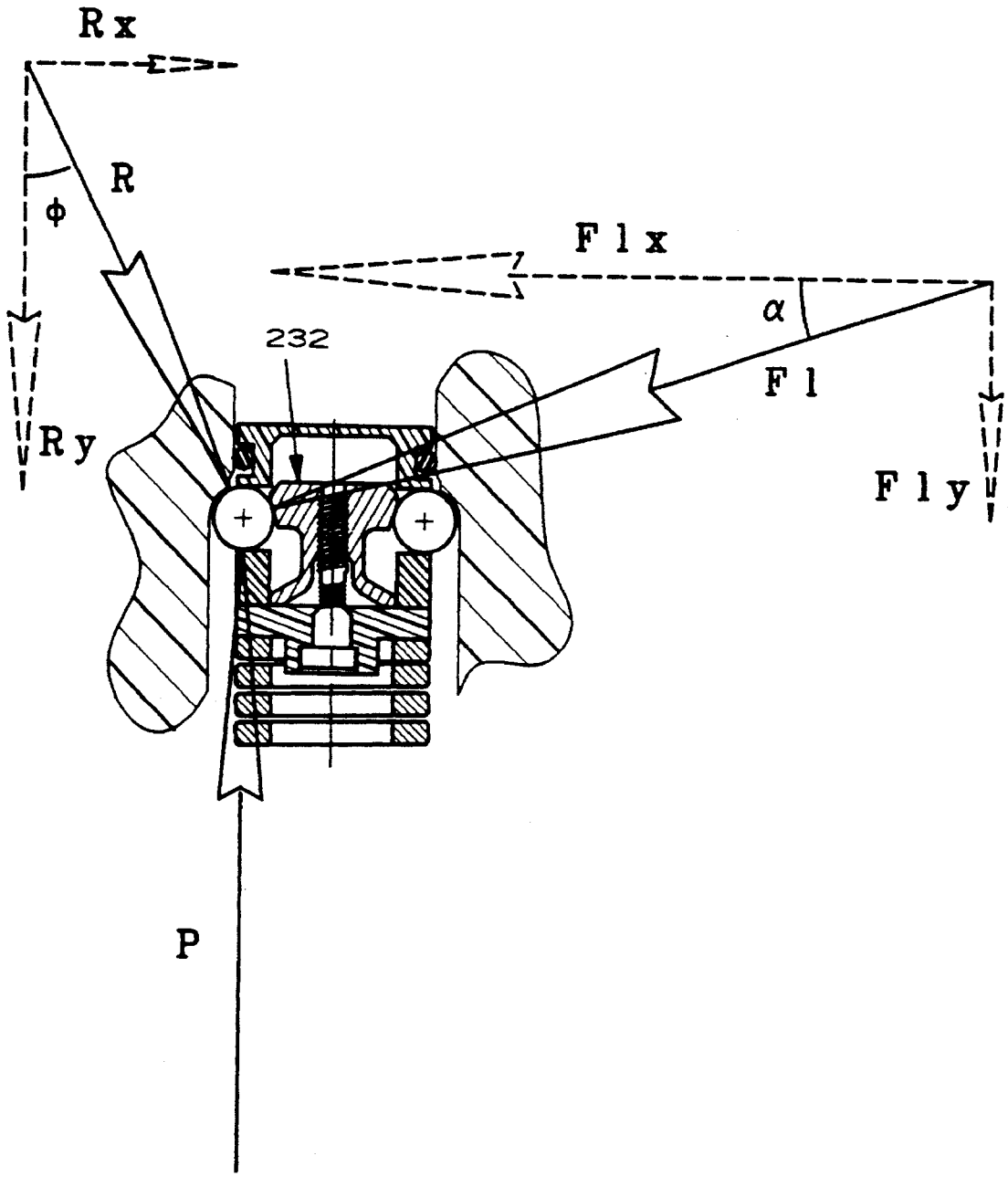
FIG. 1F is a partial cross-sectional view of the slidable link of the second embodiment of the fusible link actuator assembly wherein the taper thereof comprises a straight taper illustrating the frictionless forces acting upon the various components thereof.
Figure 1G:
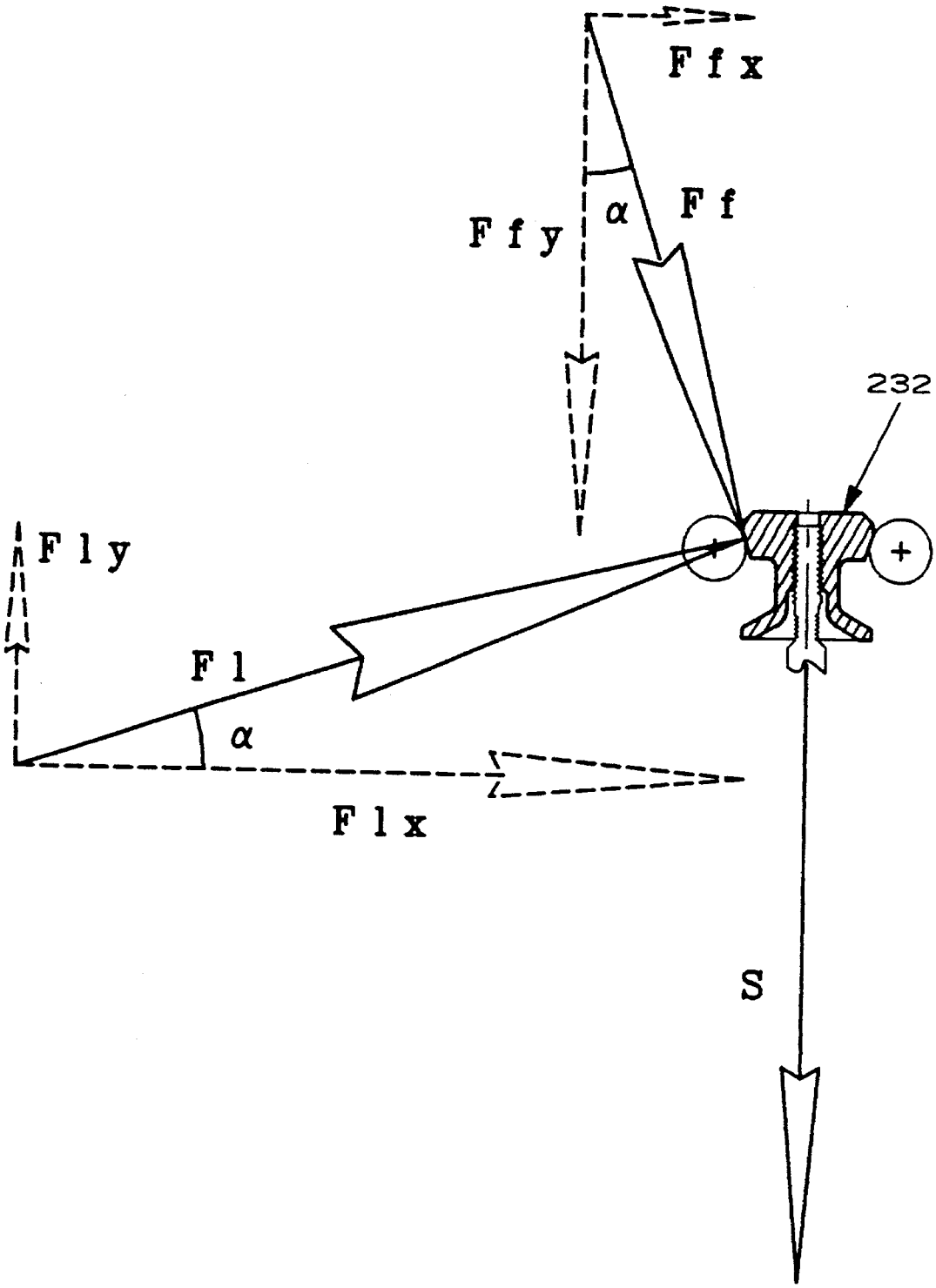
FIG. 1G is a free body diagram of the fusible link actuator assembly of FIG. 1F.
Figure 1H:
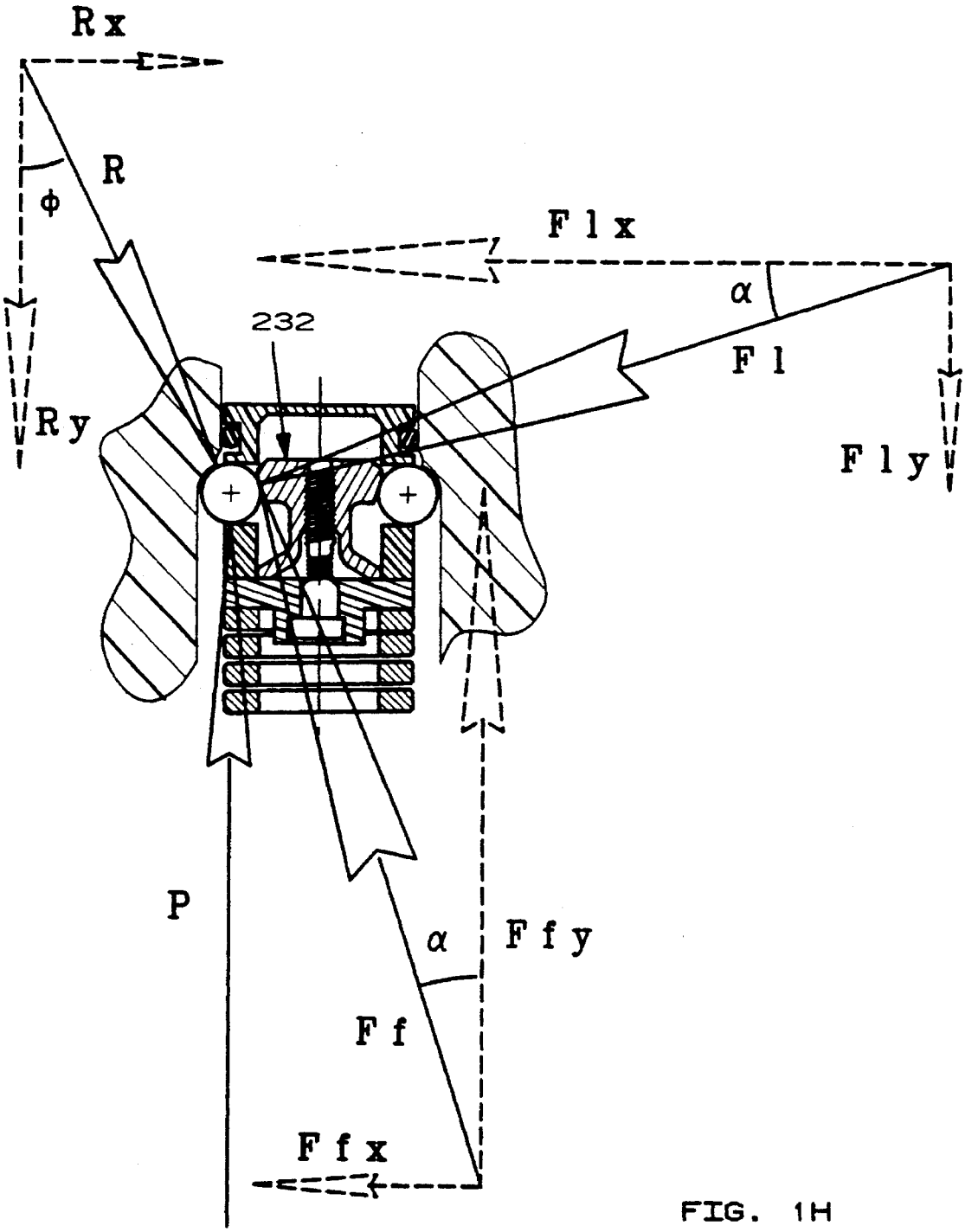
FIG. 1H is another view of FIG. 1F but with the forces including frictional forces that act upon the various components thereof.
Figure 1I:
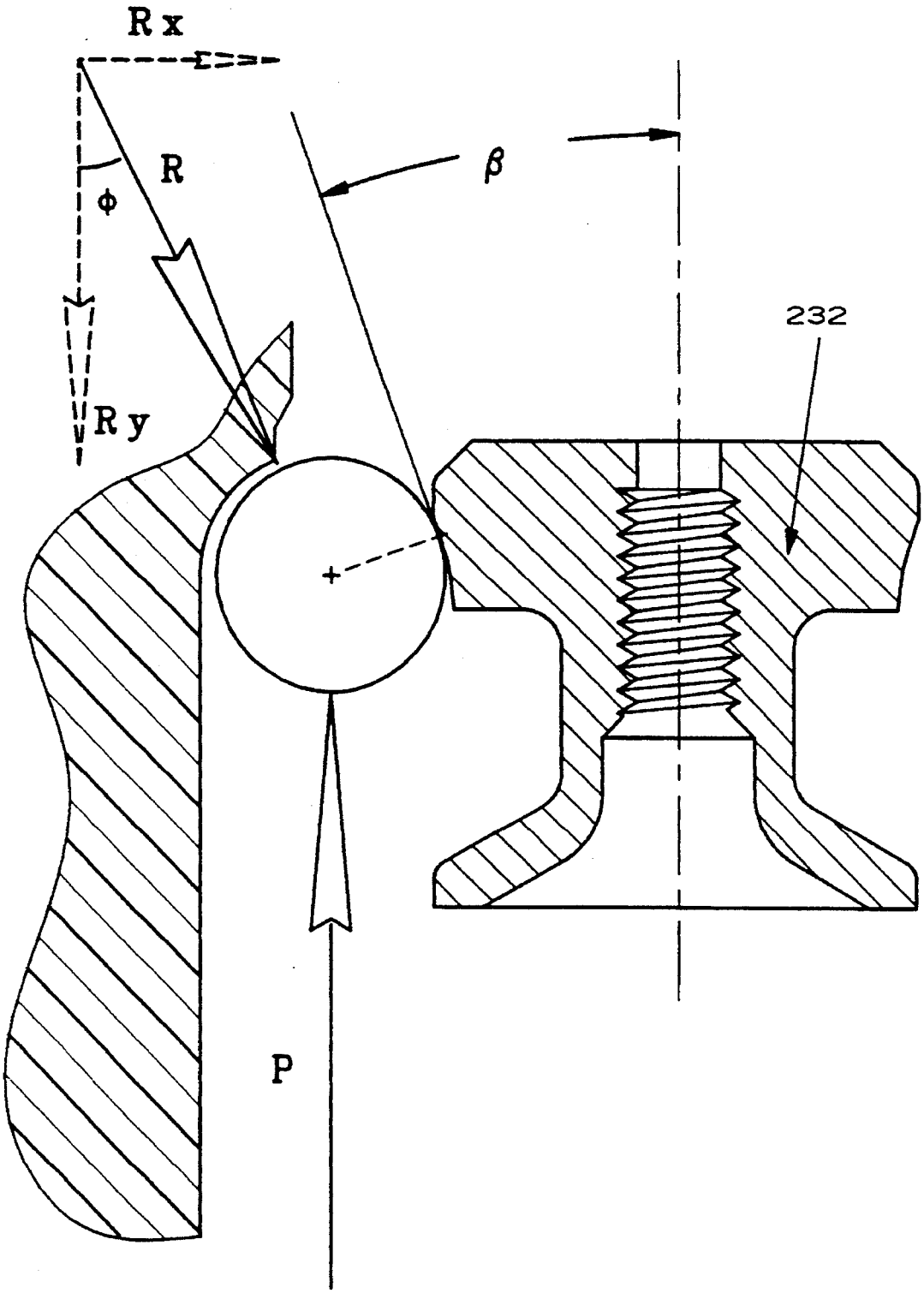
FIG. 1I is a partial cross-sectional view of the slidable link of the second embodiment of the fusible link actuator assembly wherein the taper thereof comprises a curved taper illustrating the frictionless forces including friction acting upon the various components thereof.
Figure 1K:
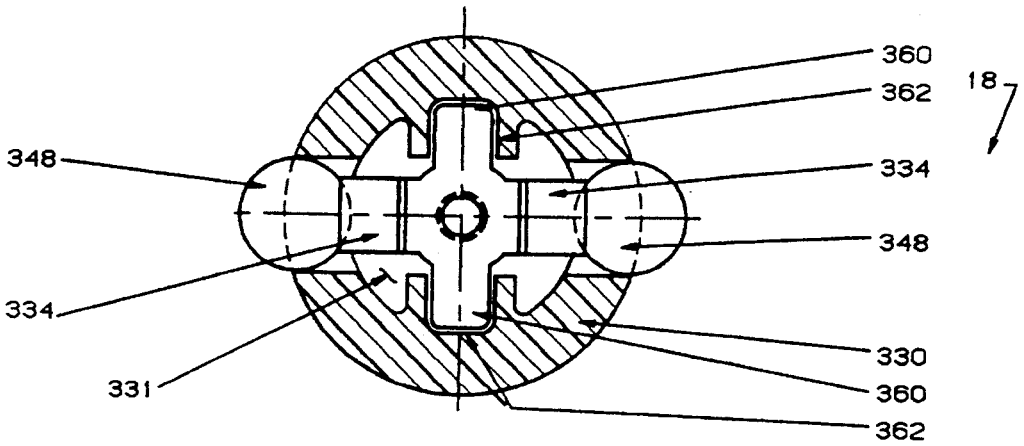
FIG. 1K is a cross-sectional view of FIG. 1J along lines 1K—1K illustrating the diametrically opposing living hinge arms and the diametrically opposing orientation arms of the fusible link actuator assembly.
Figure 1J:
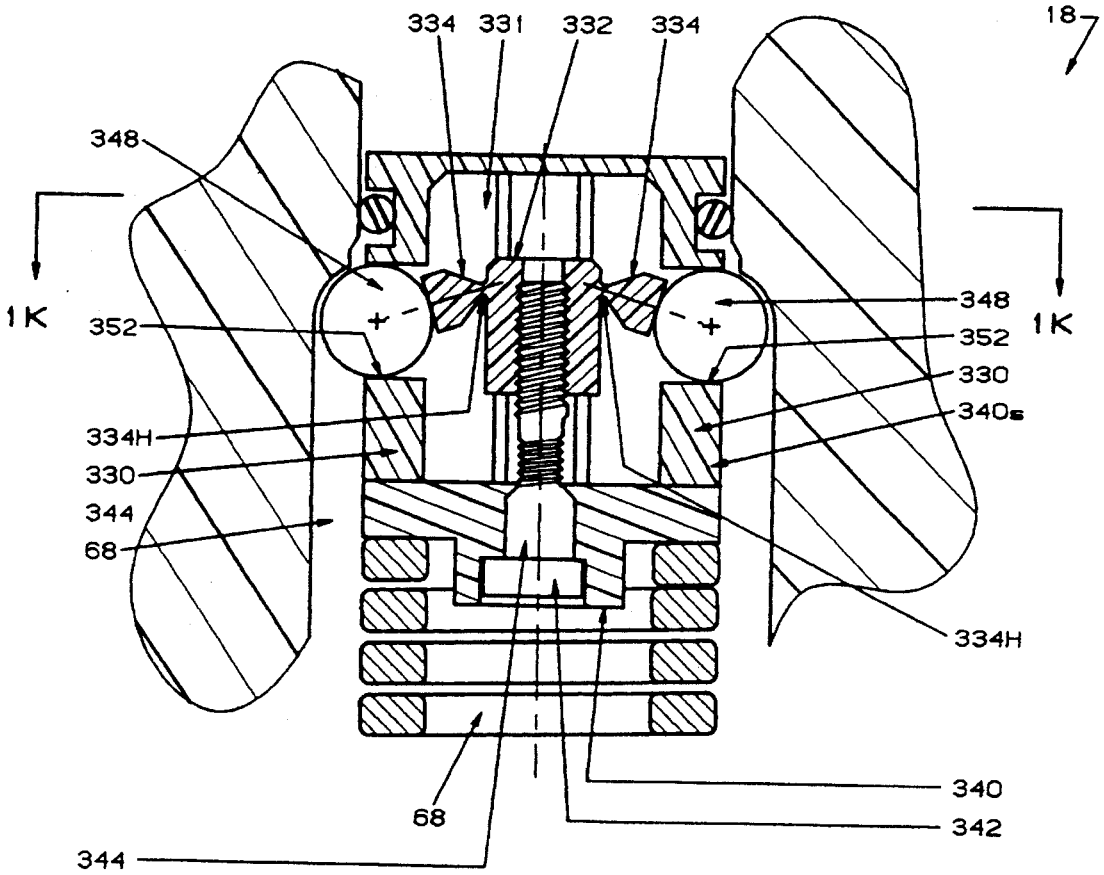
FIG. 1J is an enlarged cross-sectional view of the third embodiment of the fusible link actuator assembly having diametrically opposing living hinge arms that releasably engage the retaining balls thereby eliminating the need for the compression link spring employed in the first embodiment of the fusible link actuator assembly of FIG. 1 and thereby eliminating the need for the tapered sides of the fusible link actuator assembly of FIG. 1D–1I.

The fusible link actuator assembly 18 includes a first embodiment as shown in FIGS. 1–1C (and FIGS. 2, 3, 5, 8, 9, 10, 11 and 12), a second embodiment illustrated in FIGS. 1D through 1G, and a third embodiment illustrated in FIGS. 1J and 1K.

First Embodiment of Fusible Link Actuator Assembly

More particularly, as best shown in FIGS. 1A and 1B, the first embodiment of the fusible link actuator assembly 18 comprises a substantially cylindrical actuator housing 30 including a blind link hole 31 in which is positioned a substantially cylindrical slidable link 32. The slidable link 32 comprises a annular groove 34 positioned about its circumference at the lower (rearward) portion of the slidable link 32. As shown, the groove 34 is preferably semicircular in cross section. The slidable link 32 also comprises a blind spring hole 36 for receiving a compression link spring 38.

An actuator cap 40 is positioned over the opened end of the blind link hole 31 of the actuator housing 30 containing the Slidable link 32. The actuator cap 40 and the lower end of the blind link hole 31 may include mating steps 40S for concentric mating of the cap 40 and the hole 31.

A fusible link, such as a fusible plastic bolt 42, is inserted through a hole 44 in the actuator cap 40, and then extends through the compression link spring 38 in the blind spring hole 36 to threadably engage a threaded hole 46 in the top of the spring hole 36 of the slidable link 32, thereby securely retaining the slidable link 32 fully downward within the actuator housing 30. It is noted that the length of the compression link spring 38 relative to the depth of the spring hole 36 is such that the compression link spring 38 is under full compression inside of the spring hole 36 when the slidable link 32 is held in the fully upward, non-actuated position shown in FIG. 1A.

A pair of spherical retaining balls 48 are positioned within holes 50 formed at diametrically opposite sides of the wall of the actuator housing 30 formed by its blind hole 31. Each hole 50 includes a lip 52 to allow the retaining balls 48 to protrude from, but be retained in the holes 50. It is noted that when the slidable link 32 is secured downwardly in its non-actuated position, the outer surface 53 of the upper portion of the slidable link 32 (which is cylindrically shaped) engages the retaining balls 48, thereby forcing them to protrude outwardly from the holes 50 (see FIG. 1A).

Means are provided, such as a heater wire 54, to fuse (melt) the fusible plastic bolt 42. During fusing, water-sensing circuit 17 supplies electrical current from the battery 14B to the heater wire 54 wrapped around the fusible plastic bolt 42, causing it to melt.

Preferably, bolt 42 comprises a 1-72 bolt manufactured from a polymer plastic such as nylon or more preferably acetal. Also preferably, heater wire 54 comprises a nichrome wire having a wire size of 0.005 inches. It is noted that larger wires sizes do not burn the bolt 42 as quickly and smaller wire sizes become too difficult to handle and insure reliable assembly. Five wraps of wire are preferably employed because a smaller amount does not work as well and a greater amount is more than is needed. The bolt size of 1-72 is preferred because the smaller size of 0-80 is too weak to hold back the force of spring 38 without yielding. The next larger size of 2-56 is undesirable because it takes too long to melt. Preferably, compression link spring 38 creates about a 10 pound force on the bolt 42 when compressed. Larger springs tend to stretch the bolt 42 as the yield strength is exceeded. Smaller springs do not exert enough force on the slidable link 32 to overcome the friction between the retaining balls 48 and the slidable link 32 in a consistent reliable fashion. The battery preferably is a conventional 9 volt "alkaline battery". This provides sufficient power to reliably melt the bolt 42 even under adverse conditions such as low temperature. Smaller battery sizes are available and were tested but were not selected because they do not provide sufficient power for a margin of safety. Larger sizes of batteries or combinations of batteries would provide too much power so this excess bulk is not needed.

As shown in FIG. 1B, upon melting of the fusible plastic bolt 42, the force of the compression link spring 38 completely fractures the fusible plastic bolt 42 and forces the slidable link 32 upwardly within the blind hole 31 of the actuator housing 30. During this upward movement, as the groove 34 of the slidable link 32 becomes in alignment with the holes 50 of the actuator housing 30, the retaining balls 48 are allowed to move inwardly so as to be flush with, and not protrude from the actuator housing 30.

Returning to FIG. 1, the longitudinal bore 20 of the body 12 includes first a threaded portion 56 for receiving the threaded screw cap 22 and then a reduced-diameter portion 58 for slideably receiving the fusible link actuator assembly 18. More specifically, the reduced-diameter portion 58 is dimensioned appreciably greater than the outer diameter of the actuator housing 30 of the fusible link actuator assembly 18, thereby allowing the fusible link actuator assembly 18 to slide therein. An O-ring 60, positioned within an O-ring annular groove 62, slidably seals the fusible link actuator assembly 18 within the longitudinal bore 20 (see also FIG. 1A and 1B). A pair of blind retaining ball slots 64 are positioned at opposing sides of the lumen of the longitudinal bore 20. The blind slots 64 extend from the lowermost end of the reduced-diameter portion 58 along the majority of the length thereof before blinding out. The blind slots 64 are preferably circular in cross section and dimensioned so as to slidably receive the protruding retaining balls 48 therein.

The screw cap 22 comprises a blind hole 66 for receiving a high-compression spring 68 which forcibly engages against the top of the actuator cap 40. The actuator cap 40 includes a annular step 70 onto which the high-compression spring 68 is seated and may include an annular lip 40L allowing the high-compression spring 68 to be rearwardly connected thereto for ease in assembly (see also FIGS. 1A and 1B). The length of the screw cap 22 is appreciably greater that the uncompressed length of the high-compression spring 68 such that the threads of the screw cap 22 initially engage the threaded portion 56 before compression of the spring 68, thereby assuring proper initial threading of the screw cap 22. Additionally, a coin slot 72 is diametrically positioned in the surface of the screw cap 22 to allow forcible threading of the screw cap 22 with a coin, screwdriver or other tool, against the force of the high-compression spring 68 to compress the same. Also, the screw cap 22 preferably includes integral clips 22C for securely retaining the spring 68 in the cap 22 thereby facilitating reassembly after firing. Finally, the screw cap 22 may be provided with an O-ring 74 to prevent contamination from entering body 12 of the autoinflator 10 via the screw cap 22.

As shown in FIG. 1C, the actuator cap 40 includes a pair of diametrically opposite contact ears 76, each having electrical contacts 78 wrapped thereon. The two leads of the heater wire 54 extend in opposite directions through a slot 80 formed diametrically through the actuator cap 40 to the ears 76, and are then connected to the electrical contacts 78. A pair of longitudinal bore contacts 82 are rigidly positioned within corresponding blind contact slots 84 formed at opposing sides of the lumen of the longitudinal bore 20 and oriented 90° from the retaining ball slots 64. Electrical leads (not shown) are connected to the bore contacts 82 and extend to the water-sensing circuit 17.

Second Embodiment of Fusible Link Actuator Assembly

As shown in FIGS. 1D and 1E, the second embodiment of the fusible link actuator assembly 18 is similar to the first embodiment illustrated in detail in FIGS. 1A and 1B discussed above, but eliminates the need for the compression link spring 38 of the first embodiment.

More particularly, the second embodiment of the fusible link actuator assembly 18 comprises a substantially cylindrical actuator housing 230 including a blind link hole 231 in which is positioned a substantially cylindrical slidable link 232. The lower (rearward) portion of the slidable link 232 comprises an annular groove 234 positioned about its circumference. The upper (forward) portion of the slidable link 232 comprises a taper 236 which tapers from the uppermost end of the slidable link 232 to the annular groove 234.

An actuator cap 240 is positioned over the open end of the blind link hole 231 of the actuator housing 230 containing the slidable link 232. The actuator cap 240 and the lower end of the blind link hole 231 may include mating steps 240S for concentric mating of the cap 240 and the hole 231.

A fusible link such as the fusible plastic bolt 242 preferably a 1-72 acetal bolt is inserted through a hole 244 in the actuator cap 240 to threadably engage a threaded hole 246 extending diametrically through the slidable link 232, thereby securely retaining the slidable link 232 fully downward within the actuator housing 230 (see FIG. 1D). A heater wire 254, preferably comprising a nichrome wire, encircles the fusable plastic bolt 242 to fuse the same.

A pair of spherical retaining balls 248 are positioned within holes 250 formed at diametrically opposite sides of the wall of the actuator housing 230 formed by its blind hole 231. Each hole 250 may include a lip 252 to allow the retaining balls 248 to protrude from, but be retained in the hole 250. It is noted that when the slidable link 232 is secured downwardly in its non-actuated position, the taper 236 of the upper portion of the slidable link 232 engages the retaining balls 248, thereby forcing them to protrude outwardly hole from the holes 250 (see FIG. 1D).

It is noted that this second embodiment of the fusible link actuator assembly 18 is interchangeable with the first embodiment illustrated in FIGS. 1A–1C. Hence, the screw cap 22, the blind retaining balls slot 64, and the high-compression spring 68 described above in connection with the first embodiment of the fusible link actuator assembly 18 need not be described again in connection with the second embodiment.

It is further noted that the taper 236 of the second embodiment of the fusible link actuator assembly 18 is specifically configured so that the retaining balls 248 exert a force against the taper 236. Taper 236 is specifically dimensioned so that this force comprises a constant forward force on the slidable link 232. Consequently, upon melting of the fusible plastic bolt 242, the slidable link 232 is forced forwardly within the blind hole 231 of the actuator housing 230. During this forward movement, as the groove 234 of the slidable link 232 comes into alignment with the holes 250 of the actuator housing 230, the retaining balls 248 are allowed to move inwardly so as to be flush with, and not protrude from the actuator housing 230. In this regard, it is noted that the taper 236 must be configured and dimensioned such that an appropriate forward force is constantly exerted on the slidable link 232. The forward force must be sufficient on the one hand to sufficiently urge the slidable link 232 upwardly upon fusing of the fusible plastic bolt 242 and, on the other hand, not too great so as to place undue strain on the fusible plastic bolt 242 which could otherwise cause the bolt 242 to prematurely stretch and break. Furthermore, it is noted that the slidable link 232 must be made of a material such as metal having sufficient hardness to minimize the effect of a dimple formed where the retaining balls 248 contact the slidable link 232.

Now referring to FIGS. 1F–1G, it is seen that the taper 236 of the slidable link 232 comprises a straight taper at a specific angle $\alpha$. The retaining ball 248 contacts the retaining ball slot of the longitudinal bore 20 at an angle $\phi$ which is dimensionally analyzed to equal to equal 26.7°. With a high-compression spring 68 having a 57 lb. compression force, the force P is 28.5 lbs. The force $F_1$ supplied to the slidable link 232 is at angle $\alpha$.

The $F_{1y}$ component of force $F_1$ is selected to be 4 lbs. The fusible bolt 242 link will then be in tension by 4+4=8 lbs. This subjects the plastic to a constant stress $\sigma$ of $$\sigma = \frac{F}{A} = \frac{8 \text{ lbs}}{\left[\frac{\pi(0.073 \text{ inches})^2}{4}\right]}$$

The 8 lb. force is a good working force for dependable operation of the moving components inside the link. As graphically illustrated in Graph 1-129 Isochronous Stress vs. Strain for DuPont Delrin in *Plastics Design Library,* the disclosure of which is hereby incorporated by reference herein, a 1191 psi stress will limit creep strain to less than 1.6% after 10 years.

The angle $\alpha$ of the taper 236 then becomes a critical angle which should result in a 8 lb. load on the bolt 242. This force preferably should not be exceeded, nor should it be less than 8 lbs. Friction between the taper 236 and balls 248 will effectively tend to reduce the 8 lb. force. For now consider the frictionless case:

Summation of the forces on the ball:

$P=R_y+F_{1y}$ $R_y=P-Fly=28.5-4=24.5$ lbs.

$Rx=F_{1x}$ and $\tan\phi=R_x/R_y$; $R_x=R_y \tan\phi$.

Therefore, $F_{1x}=R_y \tan\phi= 24.5 \tan 26.70= 12.3$ lbs.

Now $\tan\alpha= F_{1y}/F_{1x}= 4$ lbs./12.3 lbs.$\geqq 18°$.

Recall that 8 lbs. was selected as a good working force that will be reduced by friction. As shown in FIG. 1H, there is a normal force $F_1$ and a friction force $F_f$ between the ball 248 and link 232. The S force is provided by the link bolt 242 in tension. The coefficient of friction is $f_o= F_f/F_1$. There is a particular valve of $f_o$ at which the link 232 will not move after the link bolt 242 is melted. This will occur when $F_{1y} \leqq F_{1y}$ and S= 0. This is computed as follows:

$F_{1y} \leqq F_{fy}$ slide will not move

Set $F_{fy}= F_{1y}$ & solve for $f_o$ coefficient of friction $f_o = F_f/F_1$; $f_o F_1 = F_f$ $\sin \alpha = F_{1y}/F_1$; $F_{LY} = F_1 \sin \alpha$ $\cos \alpha = F_{fy}/F_f$; $F_{fy} = F_f \cos \alpha$ $F_{1y} = F_{fy} = F_f \cos \alpha = F_1 \sin \alpha = f_o F_1 \cos \alpha$ $\rightarrow \sin \alpha = f_o \cos \alpha$ $f_o = \sin \alpha / \cos \alpha = \tan \alpha = 0.325$ Therefore, if $f_o \geqq 0.325$ the link 232 will stick due to friction. For this reason the link 232 is made of hardened steel with hard chrome plating to minimize the effects of friction. The result is that the actual working force of 8 lbs. is reduced slightly but never reduced to zero as it would be if $fo \geqq 0.325$.

As shown in FIG. 1I, taper 236 may comprise a curved taper 236. This minimizes the problem with a straight angled surface in that if the link bolt 242 should increase in effective length slightly due to time-related creep effects, the 26.7° angle of the reaction force R will increase as the balls 248 move toward the centerline of the slidable link 232. As $\phi$ increases, the $R_x$ component of the reaction force R will increase the squeeze on the link 232 and the force S will increase on the bolt 242. This means a slight creep strain will generate an increase in strain on the bolt 242 and result in even more creep strain. For this reason taper 236 may have a variable angle $\beta$ or curved surface as shown in FIG. 1G. As the link 32 moves forwardly and the balls 248 rotate around their points of contact, the angle $\alpha$ will increase. The angle $\beta$ which exists at the point of contact between the balls 248 and the link 232 will be set to yield a constant 8 lb. working force as the link 232 moves forwardly. The angle $\beta$ will vary throughout the stroke of the link 232, hence the curved surface of the taper 236.

Third Embodiment of Fusible Link Actuator Assembly

As shown in FIGS. 1J and 1K, the third embodiment of the fusible link actuator assembly 18 is similar to the first and second embodiments discussed above, but eliminates the need for the compression link spring 38 of the first embodiment and eliminates the need for the taper 236 of the second embodiment.

More particularly, the third embodiment of the fusible link actuator assembly 18 comprises a substantially cylindrical actuator housing 330 including a blind link hole 331 in which is positioned a substantially cylindrical slidable link 332. The upper (forward) portion of the slidable link 332 comprises a pair of diametrically opposing arms 334 connected to the slidable link 332 by means of living hinges 334H that allow the arms 334 to pivot forwardly and collapse along the length of the slidable link 332.

An actuator cap 340 is positioned over the open end of the blind link hole 331 of the actuator housing 330 containing the slidable link 332. The actuator cap 340 and the lower end of the blind link hole 331 may include mating steps 340S for concentric mating of the cap 340 and the hole 331.

A fusible link such as the fusible plastic bolt 342 is inserted through a hole 344 in the actuator cap 340 to threadably engage a threaded hole 346 extending diametrically through the slidable link 332, thereby securely retaining the slidable link 332 fully downward within the actuator housing 330.

A pair of spherical retaining balls 348 are positioned within holes 350 formed at diametrically opposite sides of the wall of the actuator housing 330 formed by its blind hole 331. Each hole 350 may include a wedge 352 formed longitudinally along its length to wedge the retaining balls 348 therein thereby retaining the balls 348 in the hole 350. However, it is noted that the wedge 352 is dimensioned such that the balls 348 may be moved inwardly by the force of the compression spring 68 during firing.

It is noted that when the slidable link 332 is secured downwardly in its non-actuated position, the arms 336 engage the retaining balls 348, thereby forcing them to protrude outwardly from the holes 350. It is also noted that the living hinges 334H allow the arms 334 to pivot forwardly and collapse along the length of the slidable link 332 when the fusible link plastic bolt 342 is melted, thereby permitting the retaining balls 348 to move inwardly. Finally, as shown in FIG. 1K, it is noted that the slidable link 332 preferably includes a pair of diametrically opposing orientation arms 360 that slidably engage into corresponding diametrically opposing slots 362 formed along the length of the actuator housing 30. The orientation arms 360 and slots 362 assure that the diametrically opposing arms 334 are aligned with the retaining balls 348 during assembly and prevent rotation of the slidable link 332 within the actuator housing 30.

It is noted that this third embodiment of the fusible link actuator assembly 18 is interchangeable with the first embodiment illustrated in FIGS. 1A–1C and the second embodiment illustrated in FIGS. 1D and 1E. Hence, the screw cap 22, the blind retaining balls slot 64, and the high-compression spring 68 described above need not be described again in connection with the third embodiment.

It is further noted that the arms 334 and living hinges 336H of the third embodiment of the fusible link actuator assembly 18 is specifically configured so that the retaining balls 348 exert a forward force against the arms 334. Consequently, upon melting of the fusible plastic bolt 342, the arms 334 fold inwardly and the slidable link 332 is forced forwardly within the blind hole 331 of the actuator housing 330. During this forward movement, the retaining balls 348 are allowed to move inwardly so as to be flush with, and not protrude from the actuator housing 330. In this regard, it is noted that the arms 334 must be configured and dimensioned at an angle such that an appropriate forward force is constantly exerted on the slidable link 332. The forward force must be sufficient on the one hand to sufficiently urge the slidable link 332 upwardly upon fusing of the fusible plastic bolt 342 and, on the other hand, not too great so as to place undue strain on the fusible plastic bolt 342 which could otherwise cause the bolt 342 to prematurely stretch and break.

Separate Firing Lever and Elector Lever

In one embodiment of the autoinflator 10 as illustrated in FIGS. 1–7, separate firing 28 and ejector levers 140 are provided.

Figure 5:
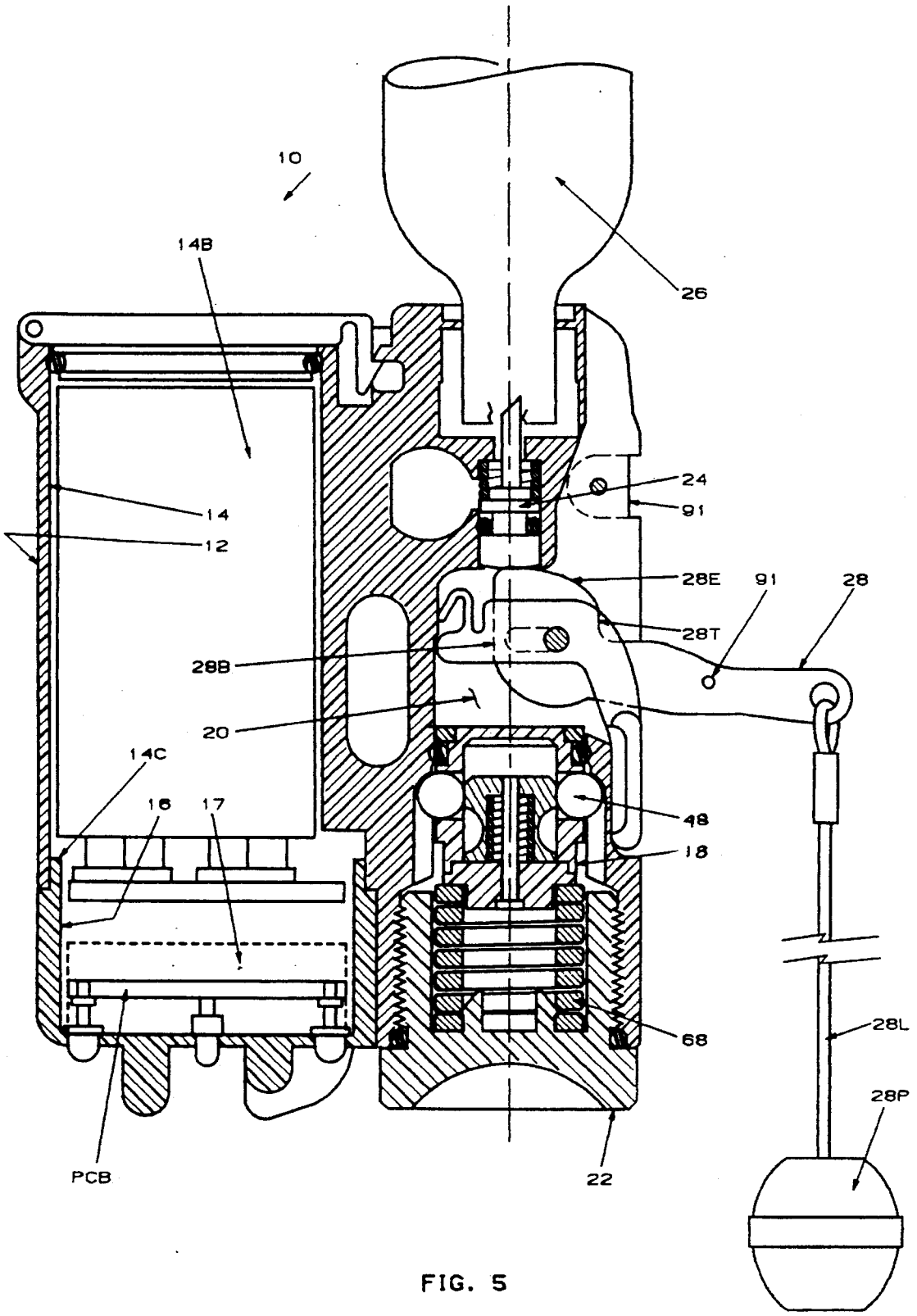
FIG. 5 is a longitudinal cross-sectional view of the electric autoinflator of the invention illustrating the manual firing lever being operated to manually fire the autoinflator.

More particularly, as shown in FIG. 1, the firing lever 28 comprises a slot 28S allowing it to be pivotably mounted within the longitudinal bore 18 at pivot point 28P. The firing lever 28 comprises a dog-leg configuration including a top end 28T and a bottom end 28B, and a rounded side end 28E. As shown in FIG. 5, a pull-ball 28P is tethered to one end of the firing lever 28 by means of a tether line 28L. The manual firing lever 28 may be provided with a conventional safety latch 91 such as shown in U.S. Pat. No. 4,416,393, the disclosure of which is hereby incorporated by reference herein. Upon pulling of the pull-ball 28P, the top end 28T and the rounded side end 28E of the lever 28 engage against the end of the firing pin 24 to force it through the frangible seal of the gas cartridge 26. Manual inflation therefore occurs.

Figure 2:
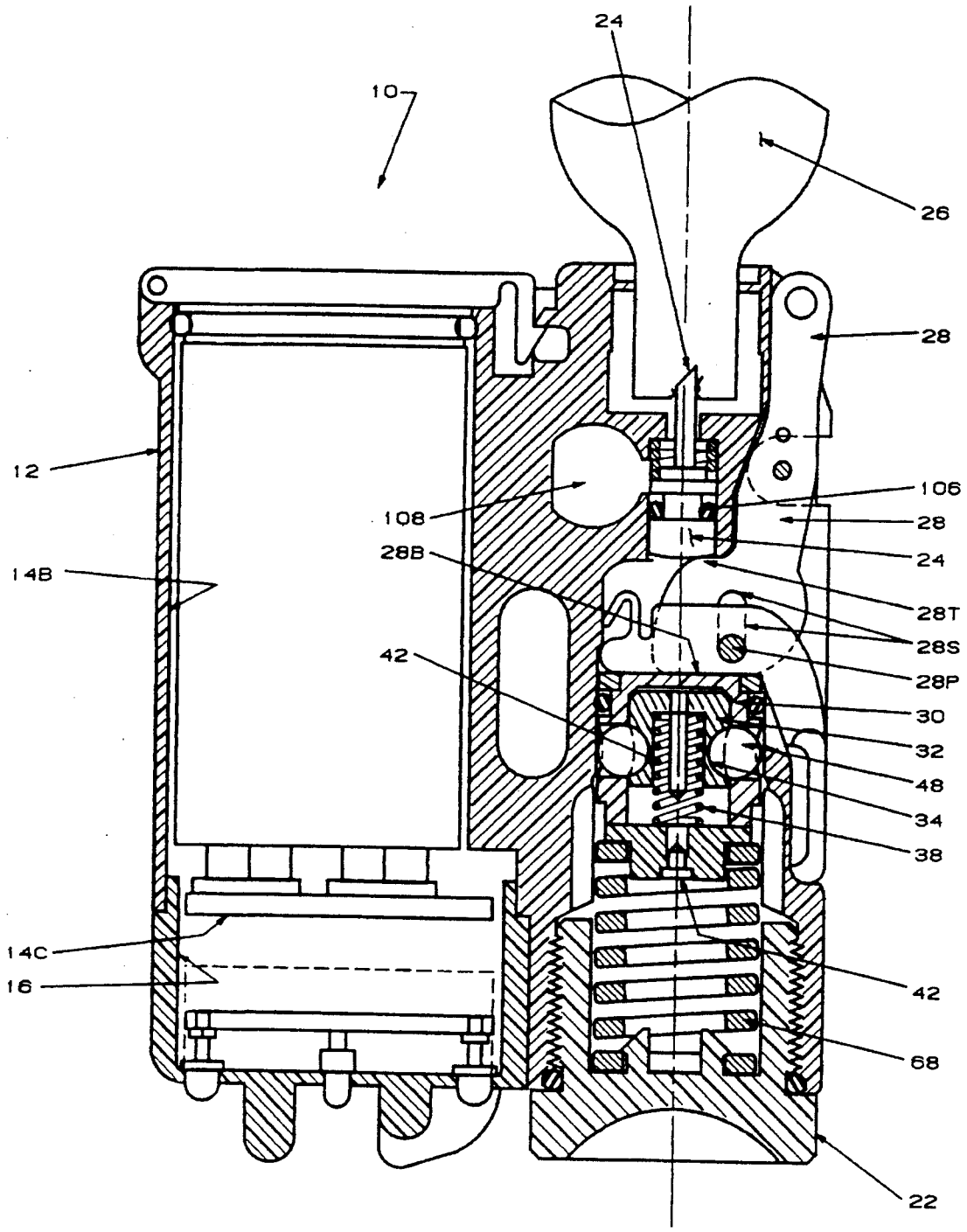
FIG. 2 is a longitudinal cross-sectional view of the electric autoinflator of the invention illustrating the first embodiment of the fusible link actuator assembly in its actuated position after firing.

During autoinflation, as shown in FIG. 2, upon fusing of the fusible bolt 42, the compression link spring 38 forces the slidable link 32 to move forwardly within the actuator housing 30 at which time the retaining balls 48 are in alignment with the grooves 34 and are now free to move inwardly into the actuator housing 30. The retaining balls 48 move inwardly under the force of the high-compression spring 68, which then forces the entire actuator housing 30 to also move upwardly to engage the bottom end 28B of the firing lever 28 with its top end 28T seated against the firing pin 24.

Further force from the high-compression spring 38 then forces the firing lever 28 to move upwardly (forwardly), with the pivot pin 28P sliding within slot 28S, to thereby function as a transfer lever to forcibly urge the firing pin 24 to pierce the frangible seal of the gas cartridge 26. The gas contained therein then escapes into the lowermost portion of the longitudinal bore 20 (sealed by O-ring 106 about the firing pin 24) and flows through a conventional manifold 108 into the inflatable device.

As shown in FIG. 1C, when the actuator assembly 18 is in its cocked position, it is not visible through openings 13 in the sides of the body 12 into the longitudinal bore 20. However, when the autoinflator 10 is fired, the actuator housing 30 will become visible through openings 13 so as to indicate a fired condition. In this regard, the actuator housing 30 may be manufactured from a material having a bright color (e.g. red or yellow) which is different from the color (e.g. black) of the autoinflator body 12.

Figure 3:
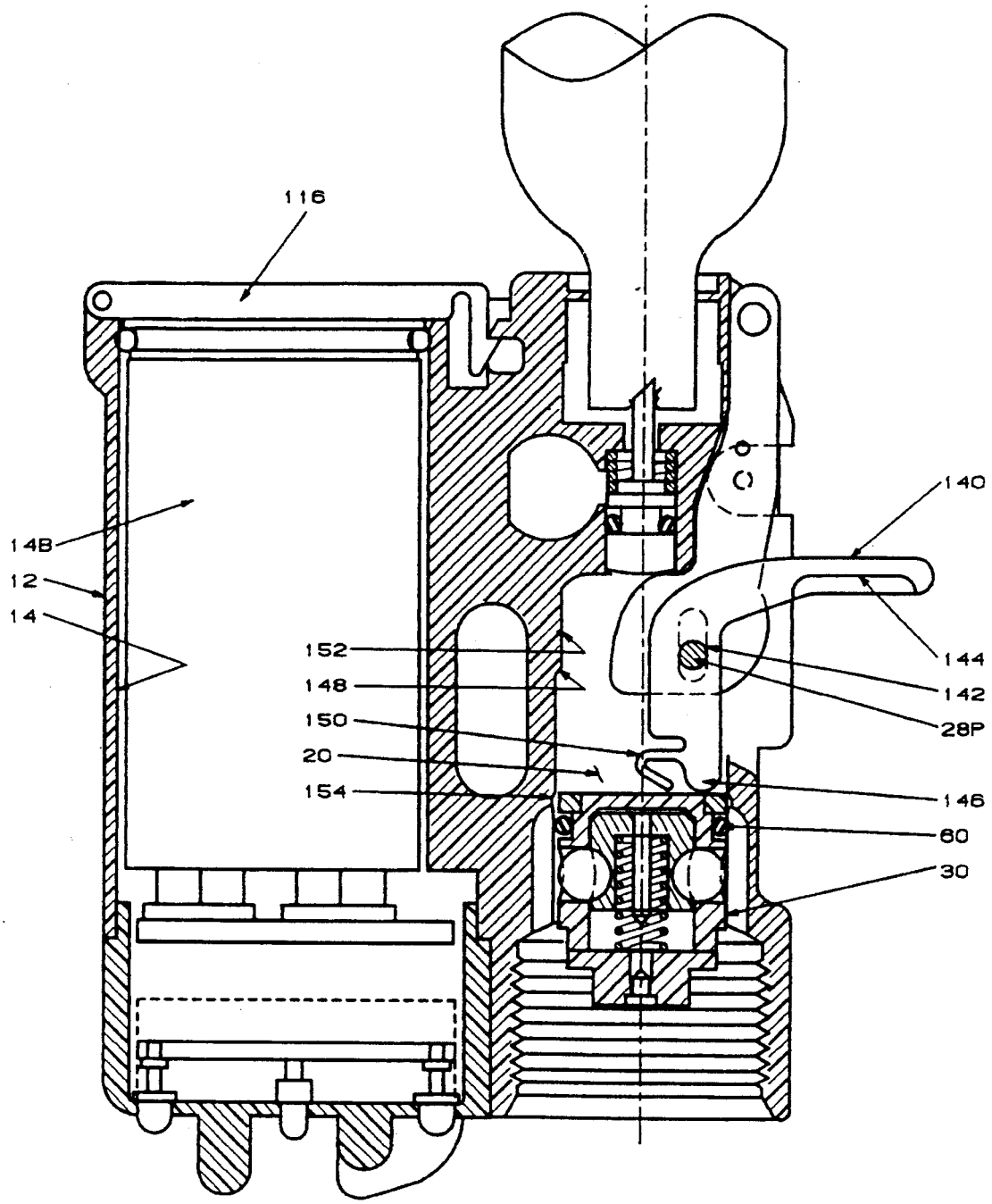
FIG. 3 is a longitudinal cross-sectional view of the electric autoinflator of the invention illustrating the first embodiment of the fusible link actuator assembly in its actuated position after firing, but with the screw cap and the high-compression spring removed and with the ejector lever being operated to remove the actuator housing from within the longitudinal bore.
Figure 4:
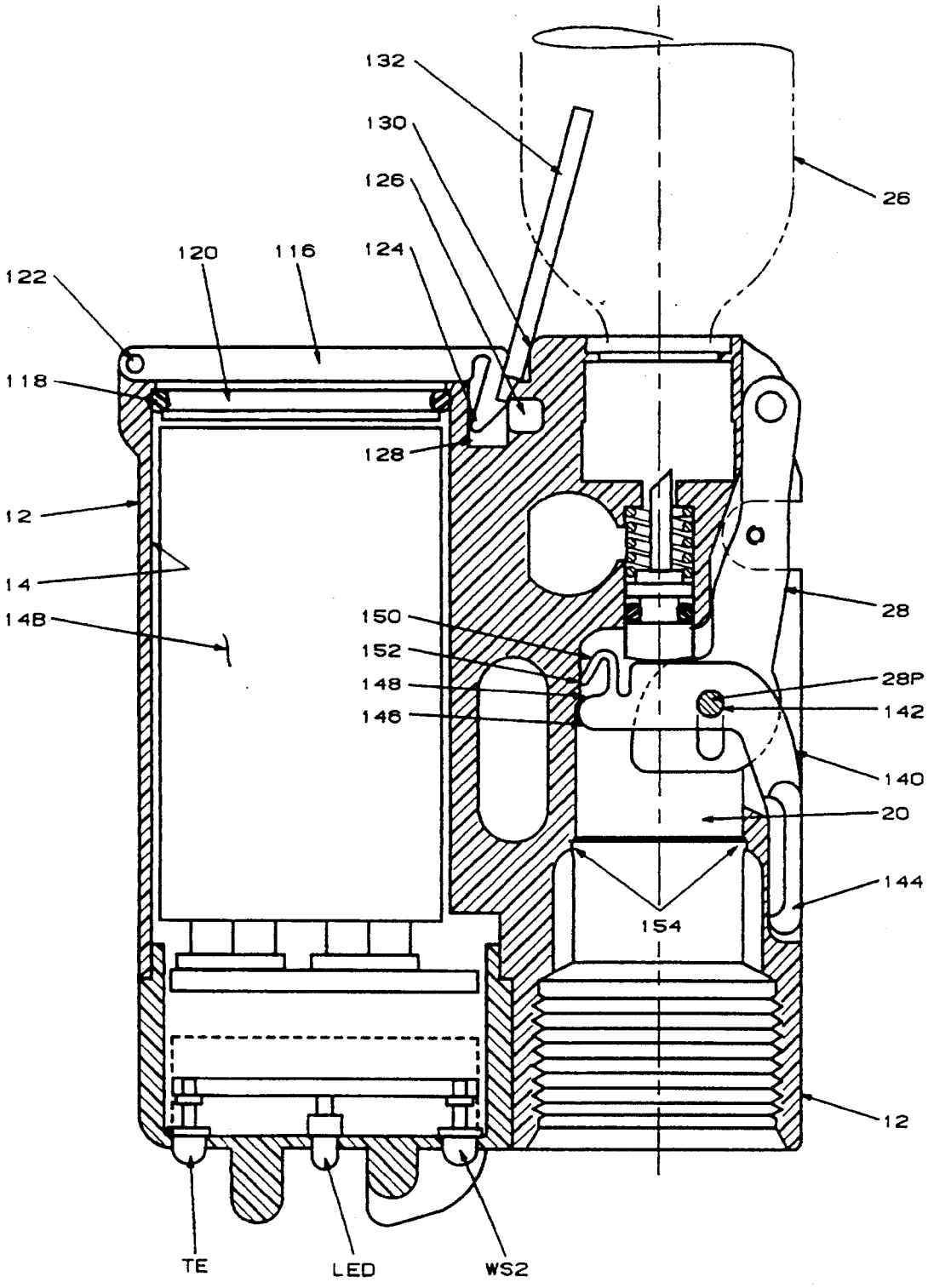
FIG. 4 is a longitudinal cross-sectional view of the electric autoinflator of the invention illustrating the first embodiment of the fusible link actuator assembly, the screw cap and the high-compression spring removed and with the ejector lever being realigned to be flush with the side of the inflator body.

Returning to FIG. 1 in combination with FIGS. 3 and 4, the ejector lever comprises a dog-leg configuration including a hole 142 positioned at the right angle bend allowing the ejector lever 140 to be pivotably mounted relative to the longitudinal bore 20 by means of the same pivot pin 28P to which the firing lever 28 is connected. A finger pad 144 is provided at one end of the ejector lever 140. The finger pad 144 is configured in such a manner that it may be easily grasped by a person's index finger and thumb allowing the ejector lever 140 to be pivoted outwardly as shown in FIG. 3. The other end of the ejector lever includes a rounded end 146 which seats at the juncture of a reduced diameter portion 148 formed in the opposite side of the longitudinal bore 20. A resilient clip 150 extends from the top of the rounded end 146 to resiliently frictionally engage the wall of the longitudinal bore 20 (see FIG. 1) or to engage into a corresponding indentation 152 in the longitudinal bore 20 (see FIG. 3) so as to resiliently secure the ejector lever 140 in its non-actuated position as shown in FIG. 1 with its finger pad 144 flush with the side of the autoinflator body 12.

After the autoinflator 10 is fired, the cap 22 is removed along with the high-compression spring 68 secured therein by means of clips 22C (see FIG. 3). However, the housing 30 of the spent fusible link actuator assembly 18 is retained within the longitudinal bore 20 due to the compression of O-ring 60. As shown in FIGS. 3 and 4, upon pivoting of the ejector lever 140, its rounded end 146 engages against the top surface of the housing 30 and forces the housing 30 downwardly such that the 0ring 60 moves into a slightly increased diameter portion 154 of the longitudinal bore 20 allowing the housing 30 to easily drop out of the bore 20.

As shown in FIG. 4, once the housing 30 is ejected from the longitudinal bore 20, the ejector lever 140 can be repositioned so that its finger pad 144 is flush with the side of the autoinflator body 12 and is resiliently held in such position by the resilient clip 150.

Combination Firing/Ejector Lever

Figure 8:
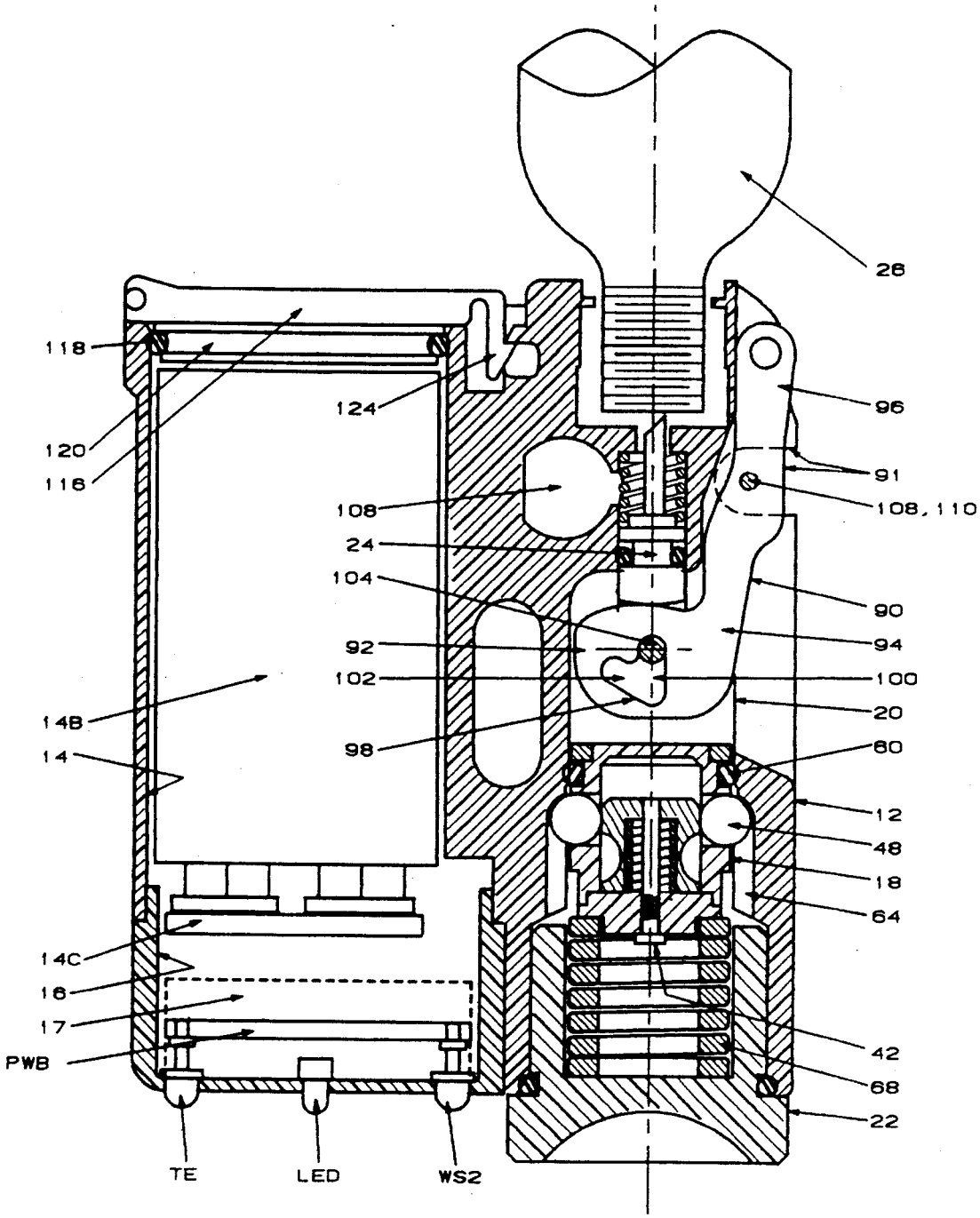
FIG. 8 is a longitudinal cross-sectional view of the electric autoinflator of the invention with a combination manual firing and ejector lever illustrating the first embodiment of the fusible link actuator assembly in its cocked, non-actuated position ready for firing.

In another embodiment of the autoinflator 10 as illustrated in FIGS. 8–12, a combination firing/ejector lever 90 is provided. More particularly, as shown in FIG. 8, the combination firing/ejector lever 90 functions not only as a transfer lever, but also as a combination (1) ejector lever to remove the spent or fired fusible link actuator assembly 18 and (2) as a conventional manual firing lever.

More particularly, the firing lever 90 comprises an elongated arm configuration having a wide shoulder portion 92, an elbow portion 94, and a hand portion 96, to which is tethered a conventional pull-ball 96B or the like. The wide shoulder portion 92 includes an inverted V-shaped slot 98 including a first slot 100 and a second slot 102 forming the V-shape. A pivot pin 104 secured within body 12 extends transversely through the longitudinal bore 20 and the V-shaped slot 98.

Figure 9:
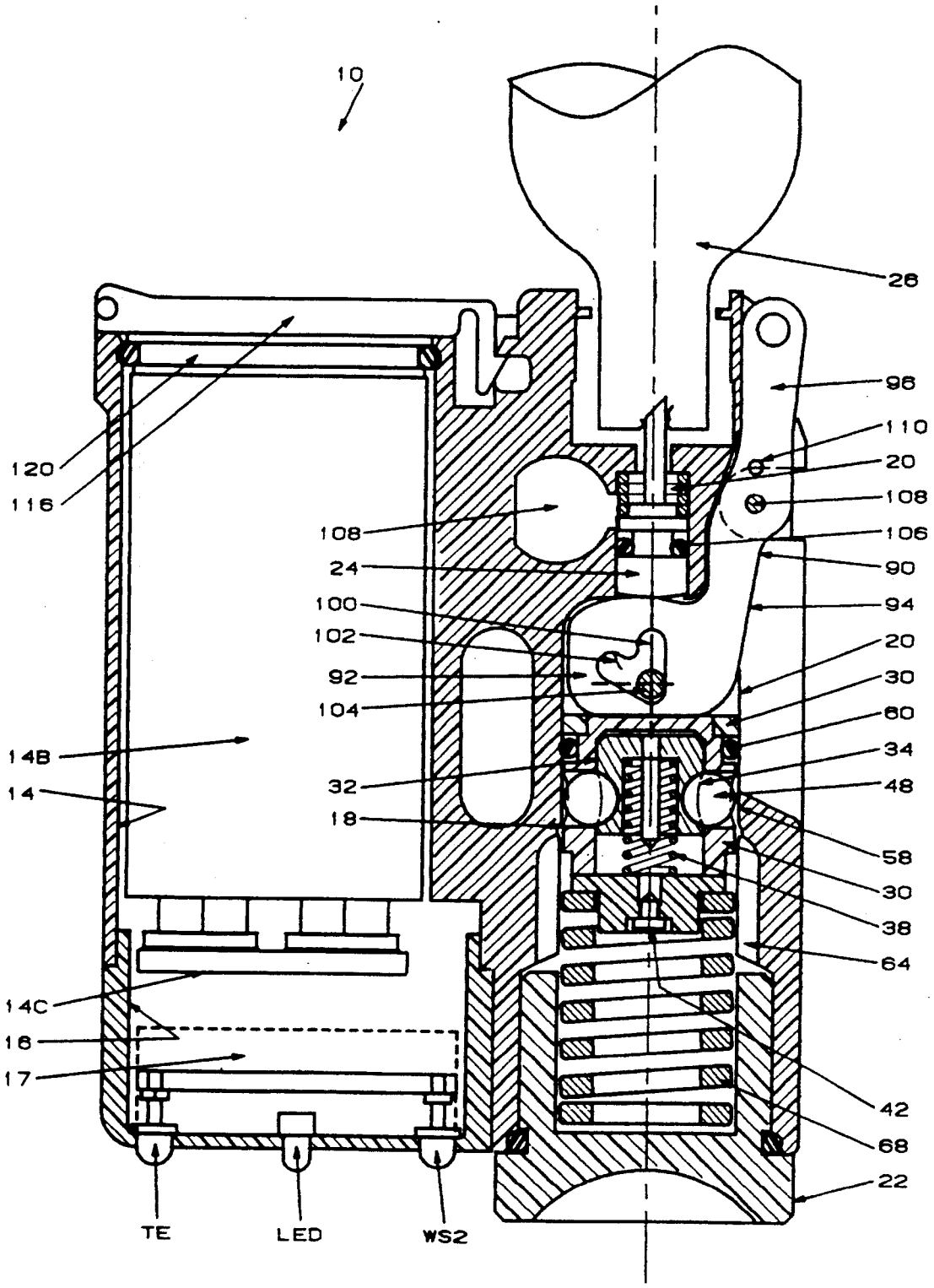
FIG. 9 is a longitudinal cross-sectional view of the electric autoinflator of the invention with a combination manual firing and ejector lever illustrating the first embodiment of the fusible link actuator assembly in its actuated position after firing.

When functioning as a transfer lever, the firing lever 90 is initially positioned as shown in FIG. 8. As shown in FIG. 9, upon fusing of the fusible plastic bolt 42, the compression link spring 38 forces the slidable link 32 to move forwardly within the actuator housing 30 at which time the retaining balls 48 are in alignment with the groove 34 and are now free to move inwardly into the actuator housing 30. The retaining balls 48 thus move inwardly under the force of the high-compression spring 68, which then forces the entire actuator housing 30 to also move upwardly (forwardly) to engage the wide shoulder portion 92 of the firing lever 90.

Further force from the high-compression spring 68 then forces the wide shoulder portion 92 of the firing lever 90 to move upwardly, with the pivot pin 104 sliding within the first slot 100 of the V-shaped slot 98, to forcibly engage the firing pin 24 which pierces the frangible seal of the gas cartridge 26. The gas contained therein then escapes into the lowermost portion of the longitudinal bore 20 (sealed by O-ring 106 about the firing pin 24) and flows through a conventional manifold 108 into the inflatable device.

As shown in FIG. 9, when the autoinflator 10 has been fired, the hand portion 96 of the firing lever 90 has been shifted forwardly. In this position, the detente 108 of the safety latch 91 is out of alignment with its slot 110, thereby readily indicating that the autoinflator 10 has been fired and the fusible link actuator assembly 18 requires replacement.

Figure 10:
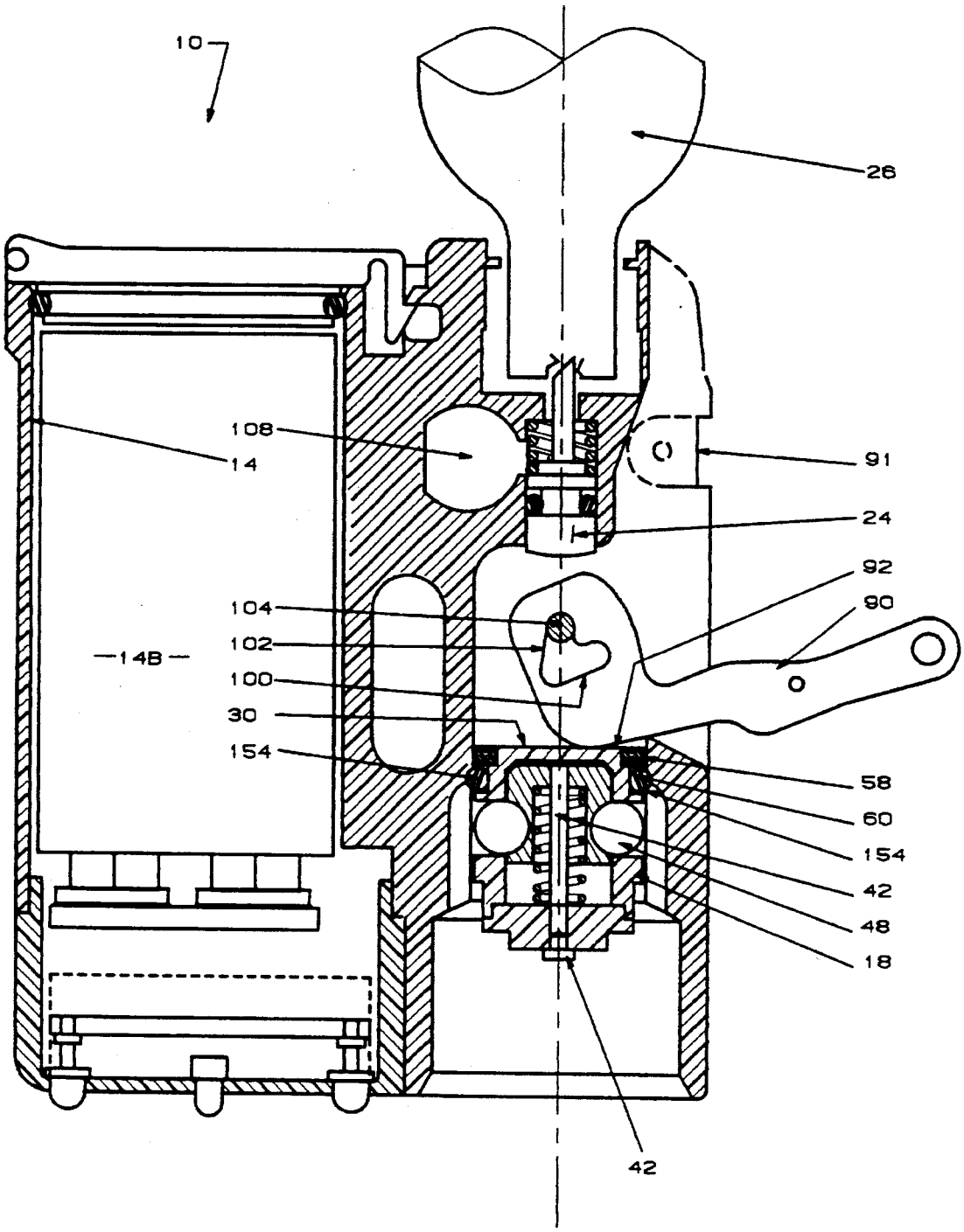
FIG. 10 is a longitudinal cross-sectional view of the electric autoinflator of the invention with a combination manual firing and ejector lever illustrating the first embodiment of the fusible link actuator assembly in its actuated position after firing, but with the screw cap and the high-compression spring removed and with the combination firing/ejector lever being operated to eject the actuator housing from within the longitudinal bore.

With regard to replacement of the fusible link actuator assembly 18, as noted above, the firing lever 90 may function as an ejector lever to remove the spent or fired fusible link actuator assembly 18. Firstly, as shown in FIGS. 9 and 10, the screw cap 22 is quickly removed with the help of a coin, and then the high-compression spring 68 removed. However, the fusible link actuator assembly 18 cannot be easily removed because it is still under tension within the longitudinal bore 20 due to the O-ring 60 engaging against the upper portion of the reduced-diameter portion 58 of the longitudinal bore 20. Notwithstanding, as shown in FIG. 10, the firing lever 90 may be shifted so that the pivot pin 104 is positioned within the second slot 102. Upward pivoting of the firing lever 90 about the pivot pin 104, then causes its wide shoulder portion 92 to engage against the bottom of the actuator housing 30, thereby forcing it upwardly until the O-ring 60 no longer engages against the lower portion of the reduced-diameter portion 58 of the longitudinal bore 20 and extends into the increased diameter portion 154. As shown in FIG. 8, the actuator housing 30 can then be easily removed and the firing lever 90 reshifted so that the pivot pin 104 is repositioned into the first slot 100 of the V-shaped slot 98 and pivoted flush with the side of the body 12. A new fusible link actuator assembly 18 may then be installed.

Figure 11:
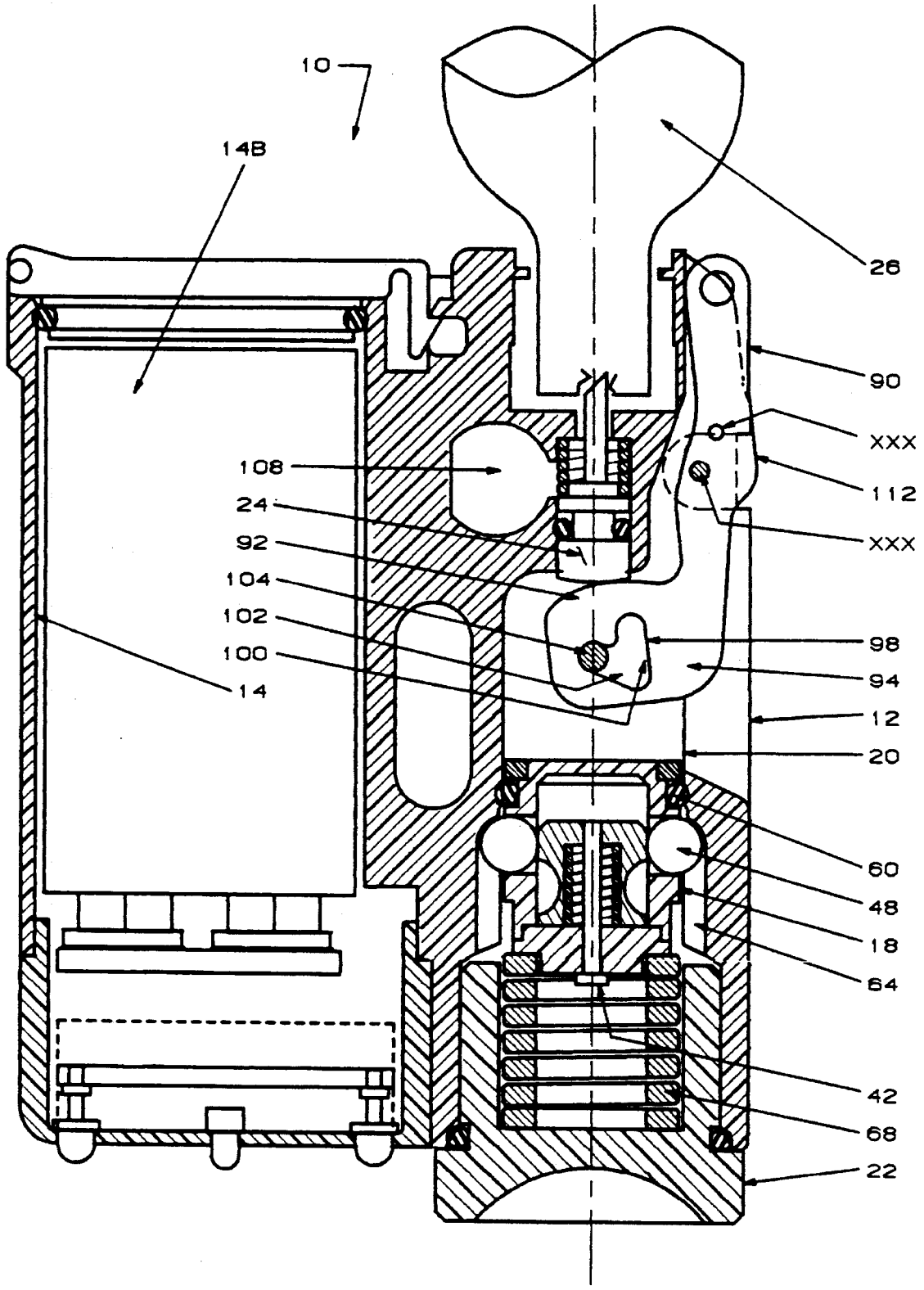
FIG. 11 is a longitudinal cross-sectional view of the electric autoinflator of the invention with a combination manual firing and ejector lever illustrating the first embodiment of the fusible link actuator assembly, the screw cap and the high-compression spring removed, but with the combination firing/ejector lever being incorrectly realigned to protrude from (not be flush with) the side of the inflator body.

As shown in FIG. 11, if the firing lever 90 is merely folded downwardly so that the pivot pin 104 remains in the second slot 102 of the V-shaped slot 98, and is not correctly repositioned into the first slot 100 of the V-shaped slot 98, a protrusion 112 thereof will extend outwardly from (i.e. not be flush with) the side of the body 12, thereby indicating incorrect realignment. Moreover, despite such an indication, should the spent gas cartridge 26 nevertheless be removed and a new one is installed, it will be immediately fired because the firing pin 24 is being held downwardly by the firing lever 90. Thus it should be appreciated that the specific configuration of the firing lever 90 not only facilitates removal of the spent fusible link actuator assembly 18, but also assures proper reassembly of a new gas cartridge 26.

Figure 12:
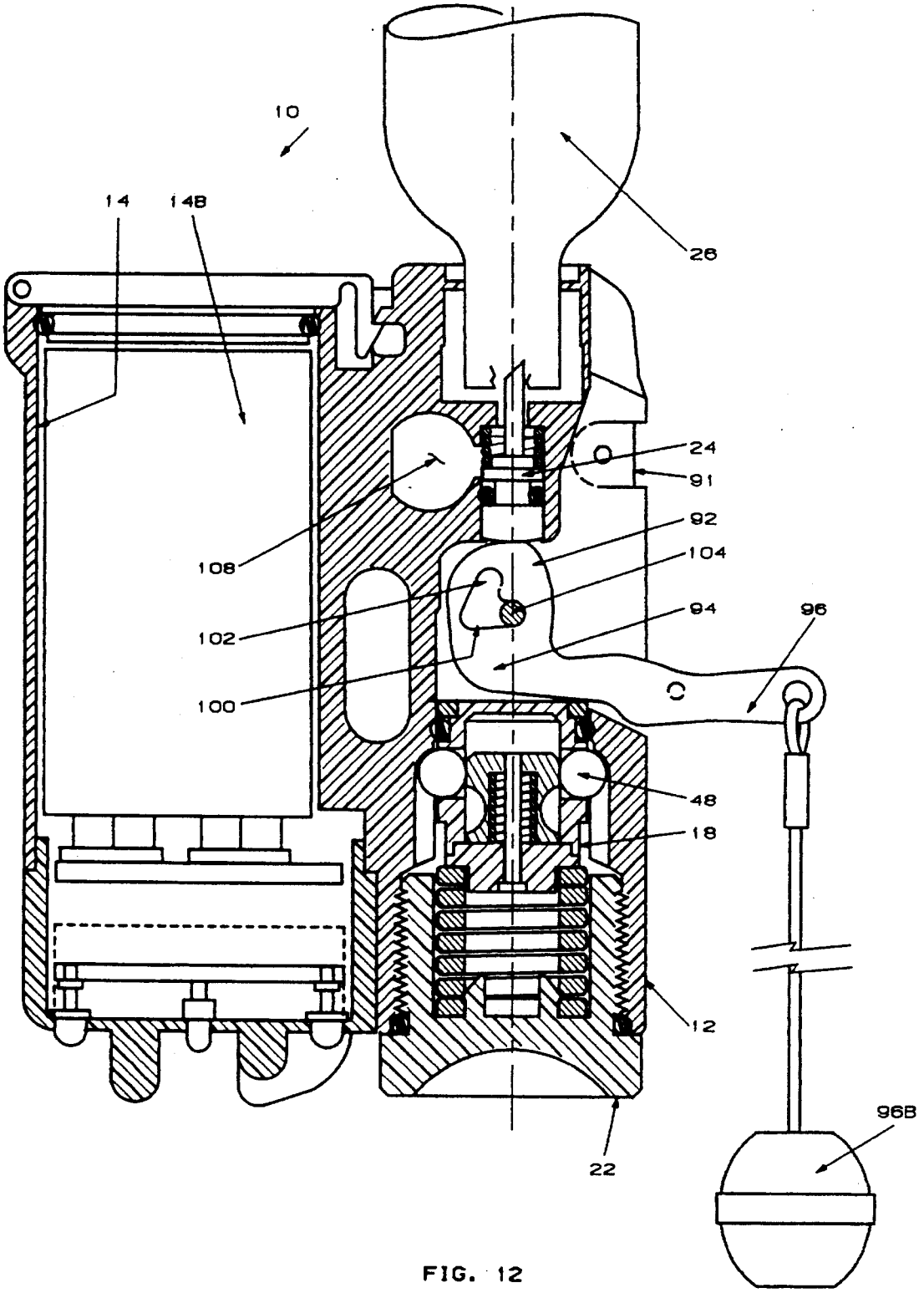
FIG. 12 is a longitudinal cross-sectional view of the electric autoinflator of the invention illustrating the combination firing/ejector lever being operated to manually fire the autoinflator.

Finally, as shown in FIG. 12, the firing lever 90 may function in the conventional manner to manually fire the gas cartridge 26 by simply pulling on the tethered pull-ball 96B whereupon the firing lever 90 pivots on the pivot pin 104 and the bottom corner surface of its wide shoulder portion 92 then engages against the pivot pin 104 to fracture the frangible seal of the gas cartridge 26.

Battery and Printed Circuit Board Compartments

Figure 7:
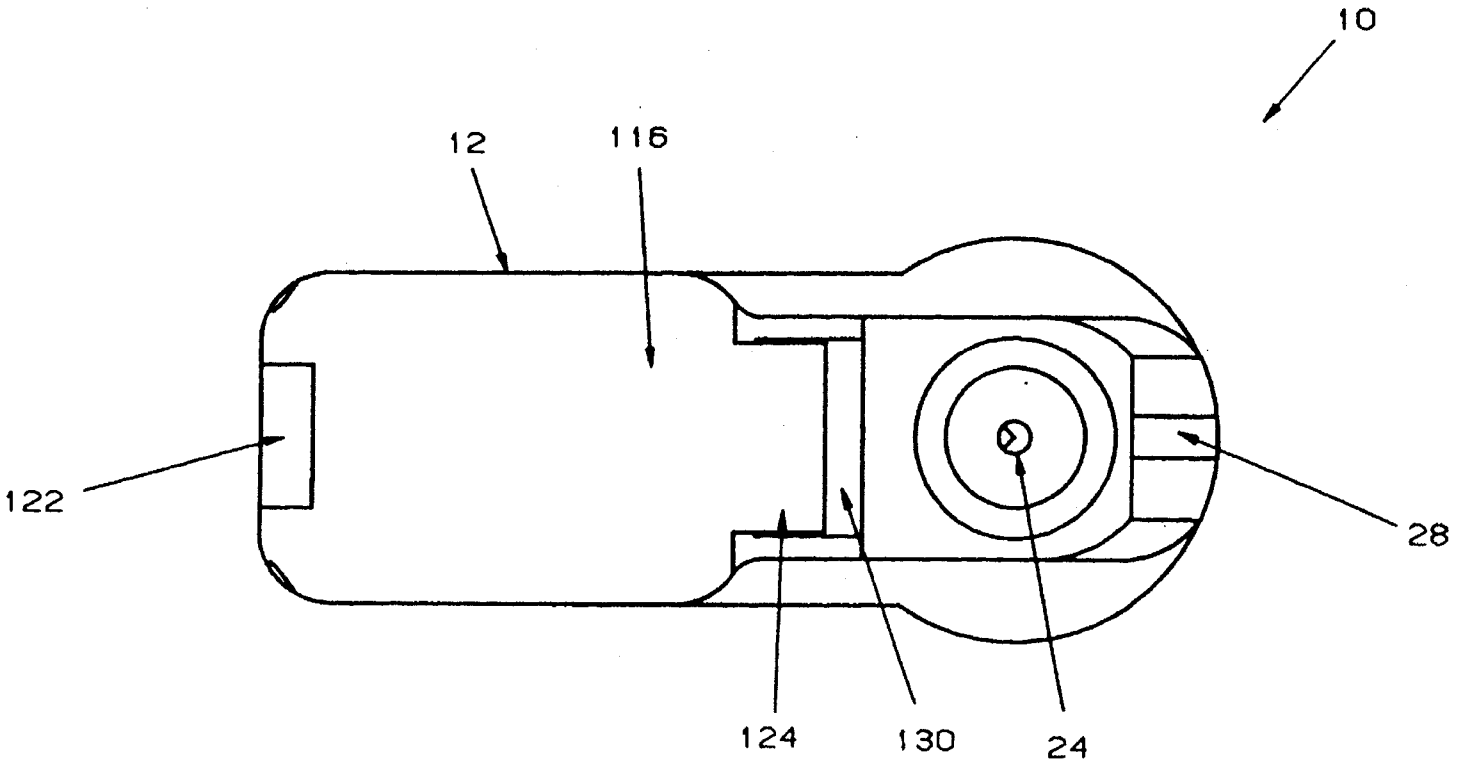
FIG. 7 is a top view of the electric autoinflator of the invention illustrating the battery compartment cap (with gas cartridge removed)

Returning to FIG. 1, the printed circuit board PCB containing the water-sensing circuit 17 is potted into a printed circuit board compartment 16 in the uppermost area of the body 12 of the autoinflator 10. As shown in FIGS. 4 and 7, a battery compartment cap 116 is sealingly positioned over the opened end of the battery compartment 14 by means of an annular O-ring 118 positioned about a boss 120 of the cap 116 which extends partially into the battery compartment 14. The side of the cap 116 farthest from the gas cartridge 26 is connected to the body 12 of the autoinflator 10 by means of hinge 122. The side of the cap 116 adjacent to the gas cartridge 26 is connected to the body 12 of the autoinflator 10 by means of a releasable latch 124, integrally formed with the lid 116, which fits into a slot 128 and then engages under a lipped slot 126 when the cap 116 is closed, thereby rigidly securing the cap 116 into sealing position about the opened end of the battery compartment 14. A slot 130 is formed in the body 12 adjacent to the slot 128 to allow a coin 132 (or screwdriver or other tool) engaged therein, to be pivoted sideways away from the cap 116 (see FIG. 4). This pivoting movement of the coin 130 forces the latch 124 out from engagement under the lipped slot 128, whereupon the cap 116 may then be fully opened and the battery 14B removed.

Notably, as shown in FIG. 4, the positioning of the latch 124 and the corresponding slots 128 and 130 adjacent to the gas cartridge 26 (as opposed to the other side) requires that the gas cartridge 26 be removed so as to provide sufficient room during pivoting of the coin 132. The battery 14B therefore cannot be removed without first removing the spent gas cartridge 26. As described below, the water-sensing circuit 17 will not rearm itself after firing unless the battery 14B is removed. Thus, in order for the LED indicator to indicate proper operating condition, this particular arrangement requires removal of both the spent gas cartridge 26 and the battery 14B and therefore encourages replacement with a new gas cartridge 26 and battery 14B.

Referring now to FIGS. 6A–6E, the LED indicator protrudes from the printed circuit board PCB through a hole in the bottom surface of the autoinflator body. A pair of water-sensing contacts WS1 and WS2 similarly extend from the printed circuit board PCB through holes in the bottom surface of the autoinflator body 12 to protrude therefrom. As described below in greater detail, the autoinflator 10 is fired when these terminals WS1 and WS2 are both immersed in water for a predetermined period of time.

Finally, a test terminal TE extends from the printed circuit board PCB through another hole in the bottom of the autoinflator to protrude therefrom. The test terminal TE is positioned close to the first water-sensing terminal WS1 in such a manner that the two terminals TE and WS1 may be shorted together with a coin or other tool. As described below in greater detail, when the terminals TE and WS1 are shorted together, LED indicator lights only when the battery 14B is at or above a minimum voltage and only when the water-sensing circuit 17 is operable, thereby indicating proper operating condition of the circuit 17 and the battery 14B.

A pair of protuberances 160 and 162 are provided on the bottom surface of the autoinflator body 12 adjacent to the test and water-sensing terminal TE and WS1 and the other water-sensing terminal WS2. More particularly, the first protuberance 160 positioned adjacent to the test terminal TE and the first water-sensing terminal WS1, comprises a relatively straight elongated configuration substantially equal to the thickness of the autoinflator body (see FIG. 6A) and including a rounded bottom surface (see FIG. 6D). As shown in FIG. 6C, the first protuberance is preferably gently rounded from one end to the other to form a smooth apex point 160A.

Figure 6A:
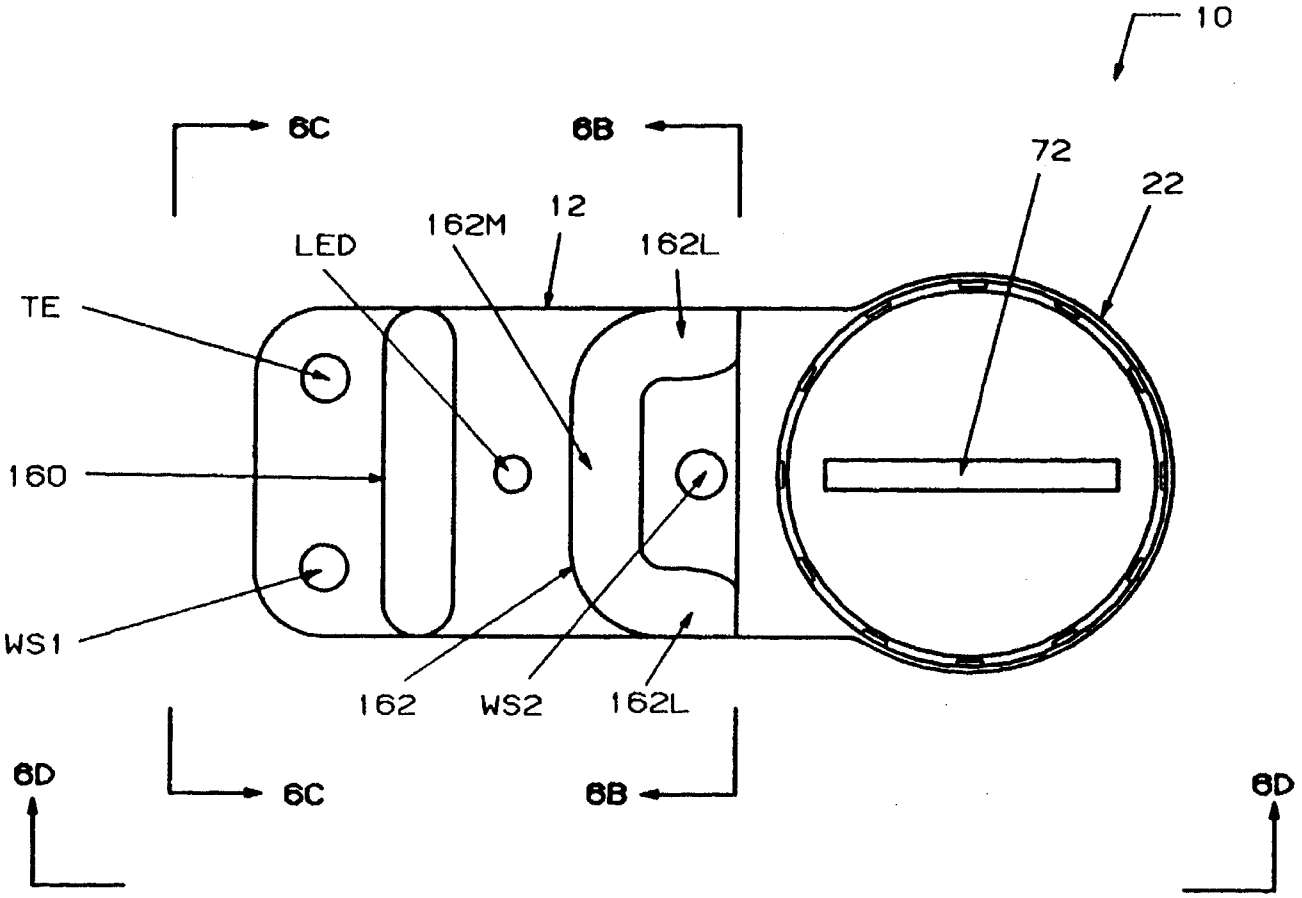
FIG. 6A is a bottom view of the electric autoinflator of the invention illustrating the water-drip protuberances surrounding the electrodes of the water-sensing circuit.
Figure 6B:
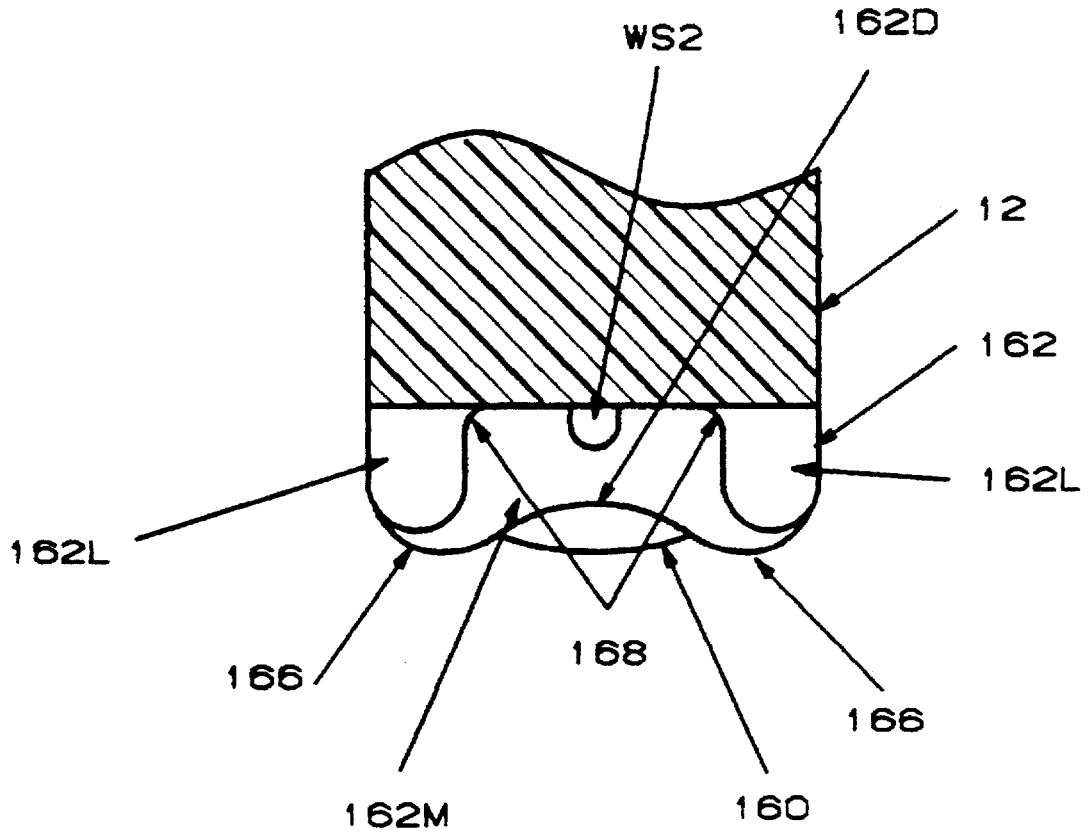
FIGS. 6B–6D are cross-sectional and side views along lines 6B—6B, 6C—6C and 6D—6D of FIG. 6A illustrating the configurations of the water-drip protuberances.
Figure 6C:
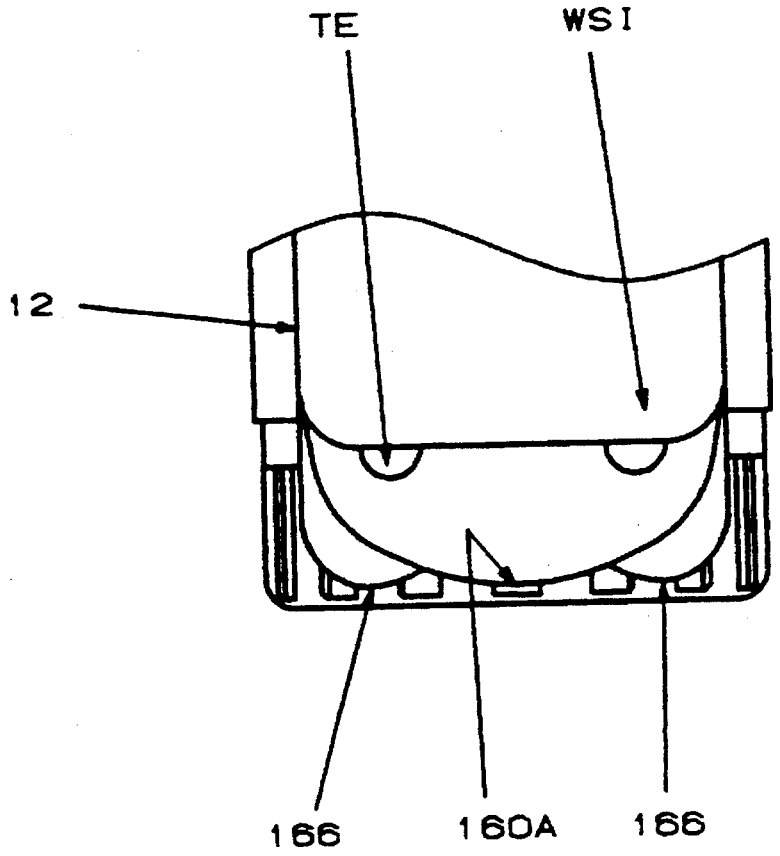
Figure 6D:
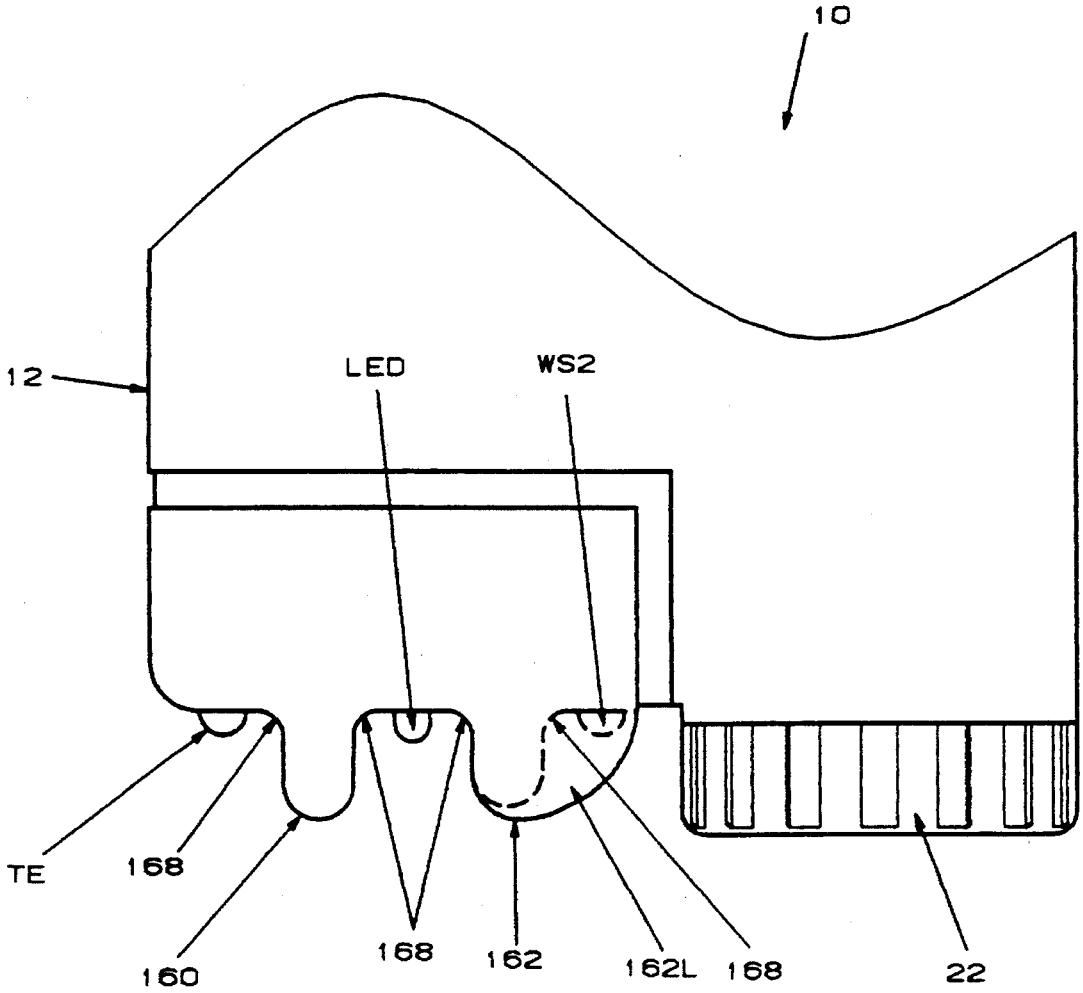
Figure 6E:
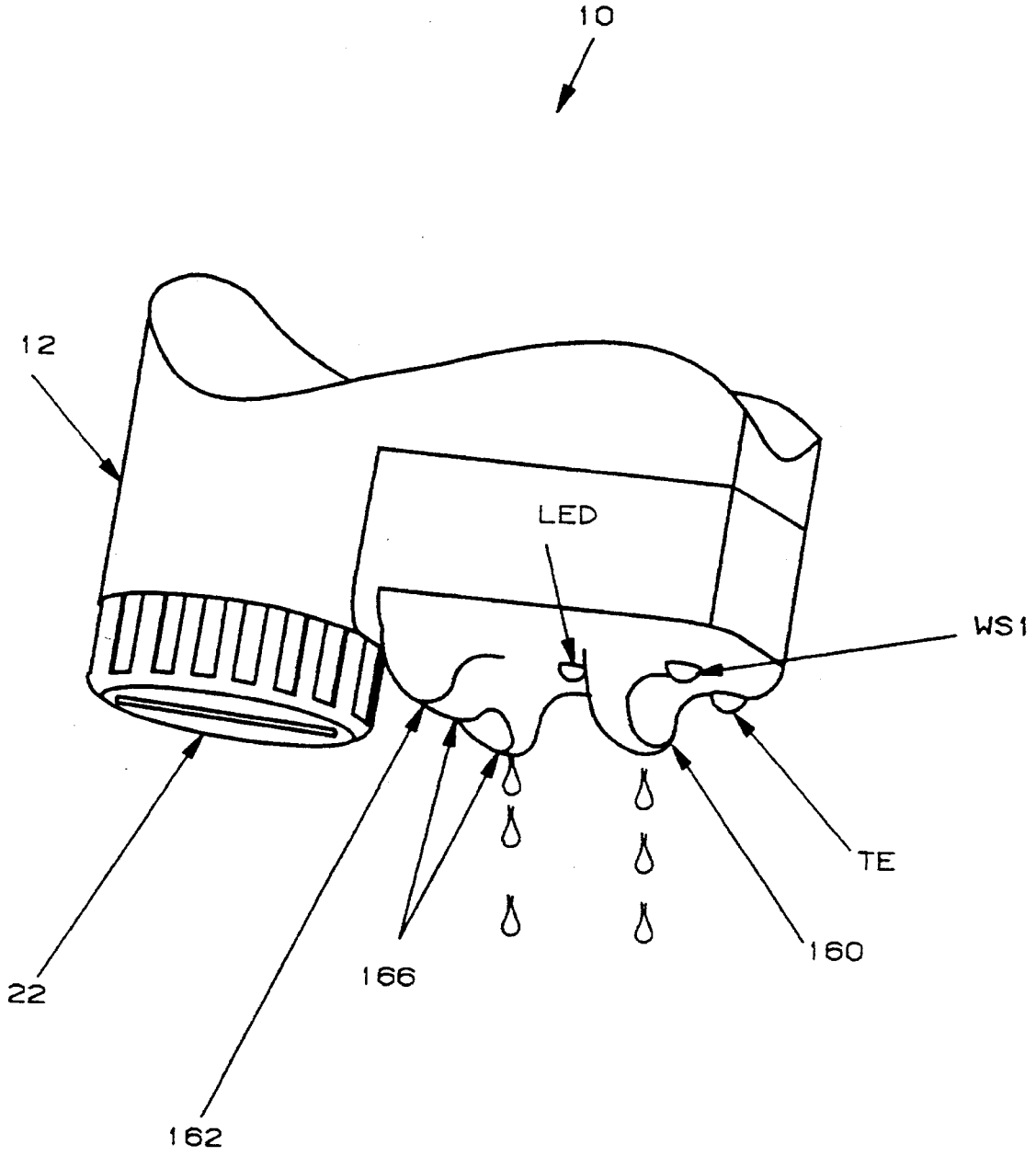
FIG. 6E is a partial perspective view of the bottom of the autoinflator illustrating how the water droplets drain off of the water-drip protuberances away from the electrodes.

The second protuberance 162 comprises a generally U-shaped configuration having a straight middle portion 162M and two leg portions 162L, with the middle portion 162M being approximately the thickness of the autoinflator body 12 such that the leg portions 162L extend significantly parallel to the front and rear surfaces of the body 12 (see FIG. 6A). Preferably, the middle portion 162M comprises an arcuate dip 162D thereby defining two lobes 166 (see FIG. 6B) whose curvatures blend into the rounded curvature of the two leg portions 162L. Finally, the bottom surfaces 168 of the body 12 adjacent to the terminals TE, WS1 and WS2 are preferably gently sloped toward their respective protuberances 160 and 162 (see FIG. 6D).

It is anticipated that the autoinflator 10 will be employed within an inflatable device in an upright manner as shown in FIG. 1. In this upright position, the terminals WS1, WS2 and TE therefore protrude downwardly. The water-drip protuberances 160 and 162 encourage water flowing along the sides of the body 12 to drip off of such protuberances 160 and 162 rather than dripping off of the terminals WS1, WS2 and TE. In this manner, the possibility of water "bridging" between the water-sensing terminals WS1 and WS2 and creating an electrically conductive path between the two, is eliminated. If the autoinflator 10 is used in an inverted position, the water-drip protuberances 160 and 162 further prevent any "pooling" of water on the surface 168 which could also cause unintended firing. Thus, it should be appreciated that the protuberances 160 and 162 assure that the autoinflator 10 will fire only upon immersion into water for the predetermined period of time and will not unintentionally fire if the autoinflator 10 is briefly submersed (less than the predetermined period) or merely splashed with water or rained on.

Combination Tethered Pull-Ball and Tool

As shown in FIGS. 13A–13C and FIGS. 13D–13F, a combination tethered pull-ball and tool 170 is provided to function as a tool to open the lid 116 of the battery compartment 14, to unthread the screw cap 22 to remove the fusible link actuator assembly 18 and to short the terminals TE and WS1 for testing.

Figure 13A:
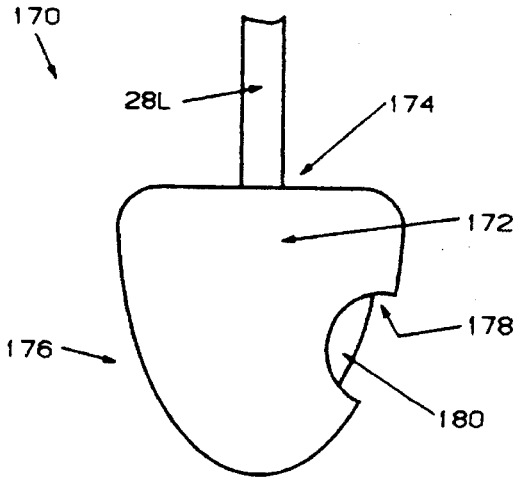
FIGS. 13A–13C and 13D–13F are front views, longitudinal cross-sectional views and front views, respectively, of two embodiments of a tethered pull-ball which functions as a tool to open the battery compartment, to unthread the screw cap to remove the fusible link actuator assembly and to short the terminals TE and WS1 for testing.
Figure 13D:
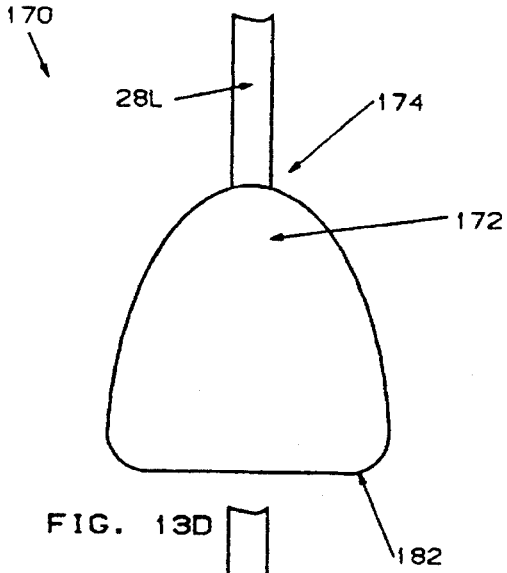
Figure 13B:
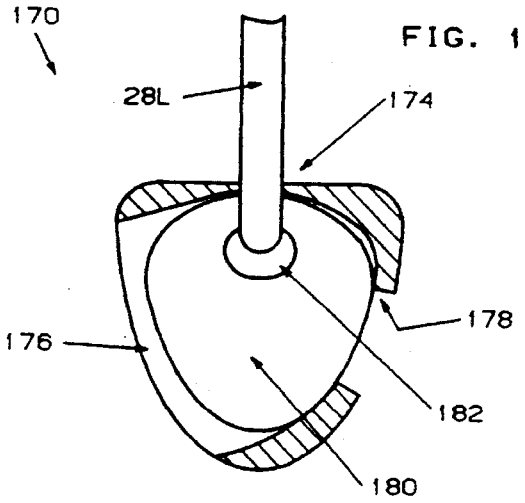
Figure 13E:
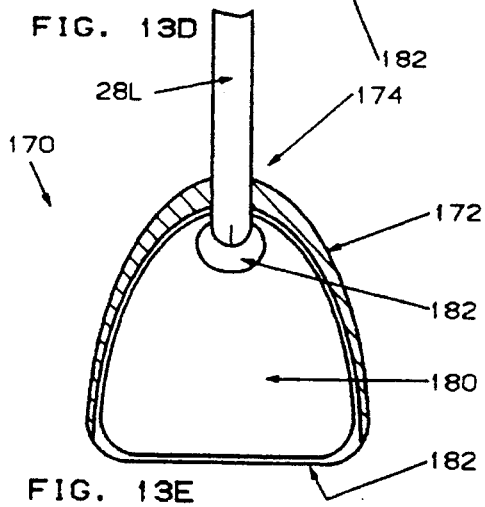
Figure 13C:
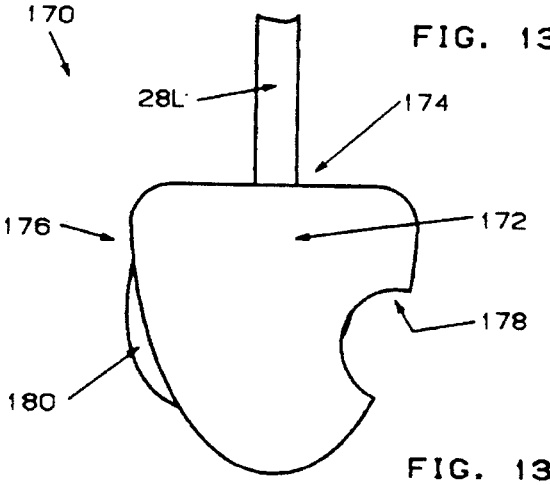

In one embodiment shown in FIGS. 13A–13C, the combination tethered pull-ball and tool 170 comprises a clamshell resilient housing 172 having a hole 174 in the upper portion thereof, a side opening 176 in one side thereof and a notched opening 178 in the other side thereof. A generally flat blade 180 is positioned within the housing 172. The tether line 28L is threaded through hole 174 in housing 172 and through another hole 182 in the top of the blade 180. The weight of the blade 180 dangling from the tether line 28L threaded through hole 174 in housing 172 keeps the blade 180 in the housing 172.

During use, slight finger pressure against notched opening 178 forces blade 180 outwardly through opening 176 (see FIG. 13C). The housing 172 may then be squeezed to hold the blade 180 is this outwardly-protruding position. The protruding blade 180 may then be used as a tool to open the lid 116 of the battery compartment 14, to unthread the screw cap 22 to remove the fusible link actuator assembly 18 and to short the terminals TE and WS1 for testing. Once released, the weight of the blade 180 dangling from the tether line 28L, moves it into the housing 176.

Figure 13F:
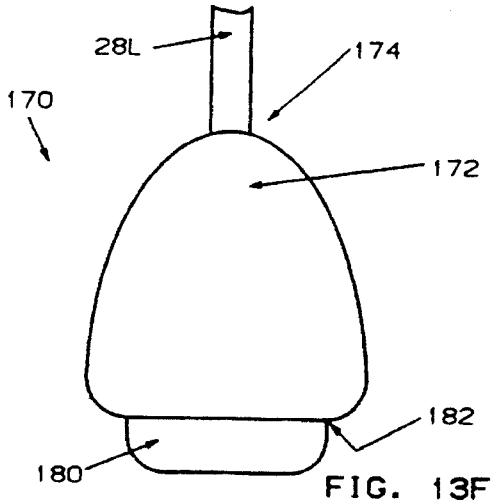

In another embodiment as shown in FIGS. 13D–13F, the resilient housing 176 comprises a top hole 174 through which is threaded the tether line 28L and connected to the blade 180 via hole 182. However, unlike the first embodiment, a single bottom opening 182 is provided in the housing 172. In this manner, loosening tension on the tether line 28L with slight squeezing on the sides of housing 172, causes the blade 180 to project outwardly from the bottom opening 182 (see FIG. 13F). The blade 180 may then be used as a tool to open the lid 116 of the battery compartment 14, to unthread the screw cap 22 to remove the fusible link actuator assembly 18 and to short the terminals TE and WS1 for testing. Making the tether line 28L taut relative to the housing 172, returns the blade 180 into the housing 172.

Water-Sensing Circuit

Figure 14:
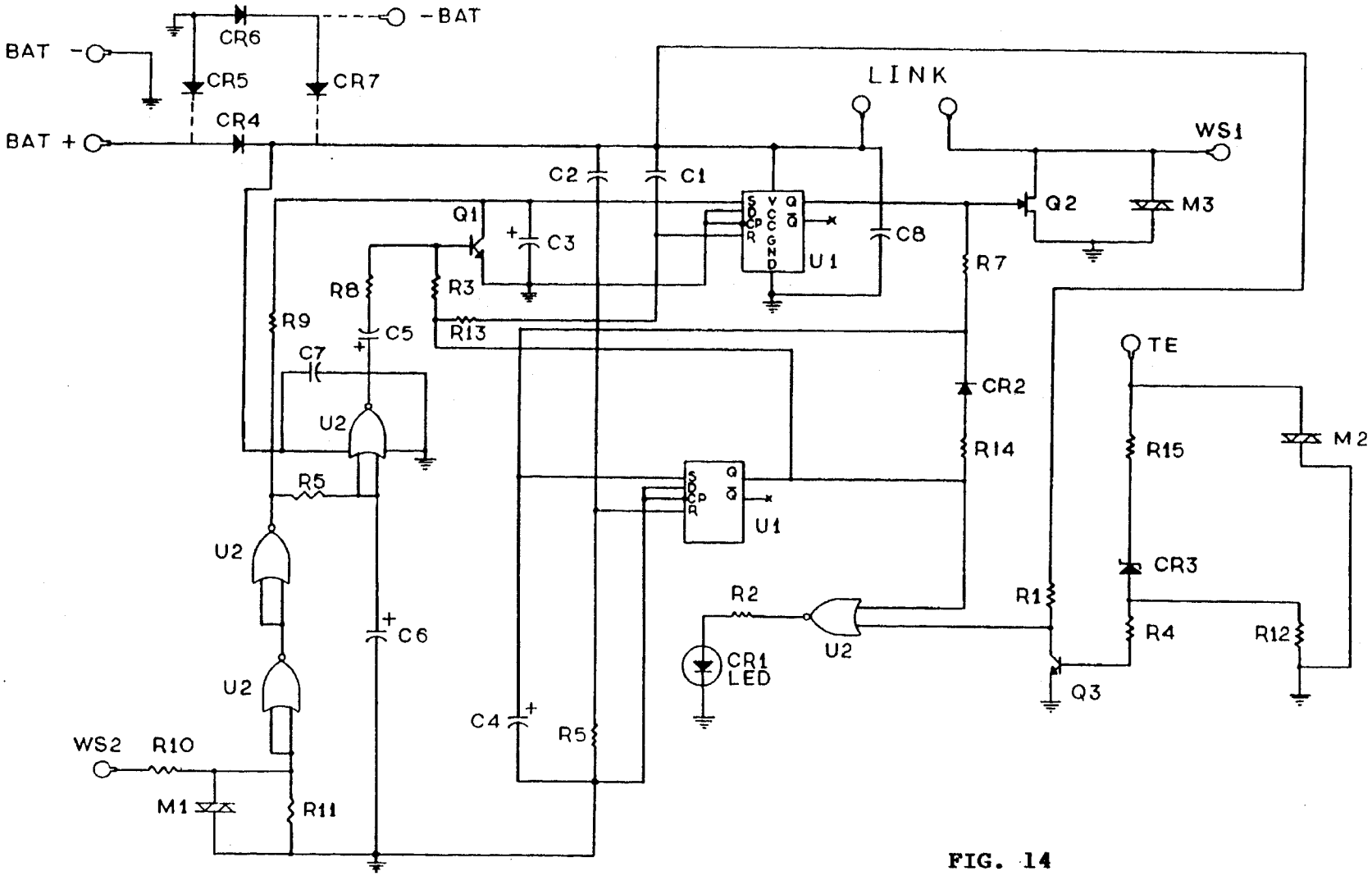
FIG. 14 is a schematic diagram illustrating the water-sensing circuit of the invention.

FIG. 14 illustrates the water-sensing circuit 17 of the invention which is mounted onto the printed circuit board PCB. The components of the various sections of the water-sensing circuit 17 are described first, and then their operation.

A latch is provided to latch the circuit so that only one activation can occur. This latch comprises dual D-type flip flops U1-A and U1-B, resistors R6 and R13, capacitors C1 and C2, and output MOSFET transistor Q2.

An activation timer is provided for timing the duration of water immersion required prior to activation. This timer comprises capacitor C3, resistor R9 and a NOR-gate U2-B used as an inverter.

A buffer amplifier provides a high impedance input and constant voltage output to the activation timer regardless of water conductivity. The buffer amplifier comprises hex inverter U2-C and resistors R10 and R11. R10 and R11 provide scaling to assure that activation occurs at the desired water conductivity.

An activation timer reset discharges the activation timer capacitor C3 after a short, predetermined interval of loss of water contact, thereby providing for quick reset to assure uniform time delay regardless of previous water contact history. The activation timer reset comprises hex inverter U2-A, resistors R5 and R8, capacitors C5 and C6, and transistor Q1.

An activation duration timer allows high current conduction through the heater wire 54 (e.g. nichrome wire) for a preset period of time sufficient to fuse the plastic bolt 42, but not so long as to create a potentially hazardous over-heating situation. The activation duration timer also disables the battery condition/continuity indicator after the operating period. The activation duration timer comprises D-type flip flops U1, resistors R3, R7 and R14, capacitor C4, diode CR2 and transistor Q1.

The battery condition/continuity indicator comprises a LED indicator that is lighted if and only if the battery voltage is above a predetermined level and the heater wire 54 and its contacts 78 and 82 are intact. The indicator comprises zener diode CR3, transistor Q3, LED indicator CR1, and resistors R1, R2, R4, R12 and R15.

Optionally, a battery polarity decoder may be provided to power the circuit regardless of the battery's 14B polarity. If employed, the decoder comprises bridge rectifier CR4, CR5, CR6, and CR7.

Transient/static voltage protection is provided to reduce the risk of damage to the circuit 17 and/or unintended operation caused by electromagnetic interference (EMI) or electrostatic discharges (ESD). This protection is afforded by metal oxide varistors MOV1, MOV2 and MOV3 and capacitors C7 and C8.

Now that the components of the various sections of the circuit 17 have been described, the following is a description of their operation.

Supply voltage $V^+$ from battery 14B is connected to the positive terminals of U1 and U2. It is noted that if the battery polarity decoder is employed, the supply voltage is connected across the (AC) inputs of the bridge rectifier CR4, CR5, CR6, and CR7 such that, irrespective of the polarity of the battery 14B, positive voltage appears at voltage terminal $V^+$ and ground appears at ground terminal GND.

Capacitors C1 and C2, connected to $V^+$, generate short pulses to the reset terminals of both flip flops FF1 and FF2 to ensure that their Q outputs are off (LOW) at power-up. Resistors R13 and R6 are timing and bleeder resistors for capacitors C1 and C2, respectively. The output of invertor U2-A is HIGH at power-up, thereby sending a short pulse of **R8*C5 duration to the base of transistor Q1 causing the positive lead of capacitor C3 to be briefly shorted to ground; however, since C3** has no stored charge, this shorting has no effect. The system is now on standby, and requires no further intervention or action from the user.

The battery condition/continuity indicator is activated when the user shorts terminals WS1 and TE together. If the heater wire 54 and the associated electrical contacts are intact, voltage $V^+$ is available at terminal TE. If voltage $V^+$ is greater than the CR3 zener voltage, plus the polarity protection diodes CR4–CR7, the base of Q3 is forward biased through R4, thereby bringing Q3 collector to near ground potential. R13 can be used to fine trim the trigger point Q3 using the zener current and the selected resistance value. A transistor was selected as the voltage trip switch due to the tight specification on the voltage transfer function.

Transistor Q3 collector grounded provides a logic LOW at the input of inverter U2-D, causing its output to go HIGH. LED indicator CR1 is forward biased by inverter U2-D through current limiting resistor R2, and therefore lights. R12 insures that the zener diode CR3 draws adequate current to perform its zener function.

If the autoinflator 10 has been actuated and not reset by physically removing and replacing the battery 14B, the LED CR1 is prevented from indicating a ready condition. Specifically, the activation duration timer U1-B Q output is HIGH and is applied to the input of inverter U2-D. This causes the gate output to remain LOW regardless of the voltage on terminal TE. When U1-B Q is LOW, the normal standby condition, the terminal TE input controls inverter U2-D output.

Upon water immersion, WS2 goes to logic HIGH through the unknown water impedance from terminal WS1. The resistor R10 is used to desensitize the input of invertor U2-C, while resistor R11 is a bleeder used to pull down the input to ground potential when no water is present. With the input of invertor U2-C being HIGH, the output of invertor U2-B is also HIGH. Current flows through resistor R9, charging capacitor C3. When the voltage of the positive terminal of capacitor C3 reaches approximately fifty percent of V+, the SET input of flip flop U1-A goes HIGH, causing the output of flip flop FF1 to go HIGH. The flip-flop output U1-A Q then turns on MOSFET transistor Q2, which shorts the heater wire 54 to ground, thereby supplying electrical current to the heater wire 54 to melt the fusible link 42. Autoinflator 10 therefore fires in the manner described above.

When the output of flip flop U1-A Q goes HIGH during activation, current flows through resistor R7 to charge capacitor C4. The duration of the activation is determined by the time constant R7*C4. When the positive terminal of C4, connected to the SET terminal of flip flop U1-B Q, reaches fifty percent of V+, the output of flip flop FF2 goes HIGH. Current thereby flows through resistor R3 into the base of transistor Q1, shorting capacitor C3 and the SET input of flip flop U1-A to ground, while simultaneously applying a RESET to flip flop U1-A via resistor R13. The combination of a HIGH RESET and a LOW SET thereby resets the flip flop U1-A, causing its output Q to go LOW, turning off the transistor Q2. The output of flip-flop U1-B Q is applied to invertor U2-D, disabling LED CR1. The output of flip-flop U1-B Q is latched HIGH by diode CR2 and resistor R14 until the battery is removed, or the battery is depleted.

While transistor Q2 is enabled, the heater wire 54 draws a significant portion of the battery's 14B capacity, causing voltage $V^+$ to drop as low as 3.5 volts. When the activation duration timer capacitor C4 reaches half of this reduced voltage level, flip-flop U1-A is reset by the output of flip-flop U1-B Q, as described above. As this occurs, voltage $V^+$ returns to near normal standby voltage level, creating a situation where flip-flop U1-B SET is no longer HIGH. Residual voltage on flip-flop U1-B RESET can result in the reset of flip-flop U1-B Q going LOW, thereby allowing the activation timer to function repeatedly. To ensure that flip-flop U1-B SET remains HIGH during the voltage transition, the output of flip-flop U1-B Q is applied directly to capacitor C4 through diode CR2. Resistor R14 is a current limiting resistor. Diode CR2 prevents current from flowing through flip-flop U1-B Q (LOW) while capacitor C4 is being charged by the output of flip-flop U1-A Q. Resistor R6 keeps flip-flop U1-B RESET at ground potential after the initial power-up reset pulse.

As noted above, the activation timer reset section of the circuit 17 provides a short duration discharge of activation timer capacitor C3 upon removal from water to insure full activation delay, regardless of previous water exposure history. Upon immersion, terminal WS2 goes HIGH, causing invertor U2-B to go HIGH as described above. This charges capacitor C3, as well as time delay network resistor R5 and capacitor C6 at the input of invertor 6. After the predetermined delay, the input of invertor U2-A goes HIGH, driving its output LOW. If WS2 goes LOW longer than the R5*C6 time constant, the input to invertor U2-A goes LOW, its output goes HIGH, generating a short pulse of R8*C5 duration to the base of transistor Q1. With transistor Q1 on, the positive terminal of capacitor C3 is shorted to ground which resets the timer. Capacitor C5 acts as a DC block, preventing further interaction of invertor U2-A with transistor Q1 until water is again sensed then lost, in which case capacitor C3 will again be reset. If WS2 goes LOW shorter than the R5*C6 time constant into invertor U2-A, capacitor C3 is not reset.

The EMI/ESD protection is afforded by connecting metal oxide resistors M1, M2, and M3 at each of the terminals WS2, TE, WS1, respectively, so as to rapidly clamp voltages to ground above their specified voltages. Decoupling capacitors C7 and C8 are employed to minimize internally generated circuit noise.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. An autoinflator for automatically actuating a gas cartridge upon sensing of water, comprising in combination:

a body including a battery compartment for containing a battery and including a longitudinal bore for receiving the gas cartridge;

a fusible link actuator assembly positioned within said longitudinal bore of the body and including an actuator housing including a blind link hole defining an opened rearward end, an actuator cap positioned over said opened end, and a retaining ball protruding from a side of said actuator housing which engages into a corresponding slot in said longitudinal bore to retain said actuator housing in a cocked position, a slidable link positioned within said blind link hole, said slidable link including an annular groove positioned about its circumference at a rearward portion thereof and including a taper positioned at a forward position thereof such that said retaining ball urges said slidable link forwardly, a fusible link interconnecting said actuator cap and said slidable link for retaining said slidable link rearwardly in a cocked position within said blind link hole, and means for fusing said fusible link upon being supplied electrical current thereto;

water-sensing circuit for sensing water and for supplying electrical current to said fusing means;

means for electrically connecting the battery to said water-sensing circuit for supplying electrical power thereto;

a firing pin operatively positioned within the longitudinal bore in alignment with the gas cartridge to pierce the same; and a high-compression spring for forcibly urging said fusible link actuator assembly toward said firing pin such that, upon fusing of said fusible link, said slidable link moves forwardly within said blind link hole, whereupon said annular groove moves into alignment with said retaining ball allowing said retaining ball to move inwardly and disengage from said slot in said longitudinal bore, whereupon said actuator housing is urged forwardly by said high-compression spring in operative engagement with said firing pin, whereupon said firing pin pierces the gas cartridge.

2. The autoinflator as set forth in claim 1, further including a screw cap threadably engaged into said longitudinal bore with said high-compression spring being positioned between said screw cap and said fusible link actuator assembly, whereby upon removal of said screw cap, said fusible link actuator assembly may be removed.

3. The autoinflator as set forth in claim 2, further including means for connecting said high-compression spring to said screw cap.

4. The autoinflator as set forth in claim 2, further including means for connecting said high-compression spring to said actuator cap.

5. The autoinflator as set forth in claim 2, wherein said high-compression spring includes a length relative to the distance between said screw cap and said fusible link actuator assembly such that said screw cap may initially threadably engage said longitudinal bore without compression of said high-compression spring.

6. The autoinflator as set forth in claim 2, wherein said screw cap includes a surface including a slot permitting a tool to engage into said slot to facilitate threaded engagement of said screw cap into said longitudinal bore.

7. The autoinflator as set forth in claim 1, wherein said fusible link comprises a plastic bolt which threadably interconnects said actuator cap and said slidable link and wherein said fusing means comprises a heater wire encircling said bolt to fuse said bolt upon being supplied electrical current thereto.

8. The autoinflator as set forth in claim 7, wherein said bolt comprises a 1-72 "acetal" bolt, wherein said heater wire comprises a nichrome wire having a wire size of 0.005 inches which encircles said bolt five times.

9. The autoinflator as set forth in claim 1, wherein said actuator housing further includes an O-ring positioned about its circumference for sealing engagement with said longitudinal bore.

10. The autoinflator as set forth in claim 9, further including an ejector lever operatively positioned within said longitudinal bore for ejecting said fusible link actuator assembly.

11. The autoinflator as set forth in claim 10, wherein said ejector lever comprises a manual firing lever operatively positioned within said longitudinal bore for manually urging said firing pin forwardly to pierce the gas cartridge.

12. The autoinflator as set forth in claim 1, further including window means positioned relative to said longitudinal bore to visually indicate when said fusible link actuator assembly has been actuated.

13. The autoinflator as set forth in claim 1, further including a battery compartment cap positioned over an opened-end of said battery compartment with one side of said cap farthest from the gas cartridge being pivotably connected to said body and with another side of said cap adjacent to the gas cartridge including a releasable latch for releasable connection to said body, said latch including a slot allowing said latch to be opened with a tool when the gas cartridge is removed from said body.

14. The autoinflator as set forth in claim 1, wherein said water-sensing circuit comprises an activation timer for timing the duration of water immersion regardless of water conductivity, an activation timer reset for said activation timer to assure uniform water immersion timing regardless of previous water immersion history, and an activation duration timer for timing the duration of electrical current supplied to said fusing means.

15. The autoinflator as set forth in claim 1, wherein said taper comprises a straight taper.

16. The autoinflator as set forth in claim 15, wherein said straight taper comprises an angle $\alpha$ as shown in FIG. 1G of the drawings of approximately 18 degrees.

17. The autoinflator as set forth in claim 1, wherein said taper comprises a curved taper.

18. The autoinflator as set forth in claim 17, wherein said curved taper comprises a greater angle as shown in FIG. 1I of the drawings at a point of contact with said retaining ball when said fusible link actuator assembly is in its non-actuated position than when said fusible link actuator assembly is moving forwardly during actuation.

19. An autoinflator for automatically actuating a gas cartridge upon sensing of water, comprising in combination:

a body including a battery compartment for containing a battery and including a longitudinal bore for receiving the gas cartridge;

a fusible link actuator assembly positioned within said longitudinal bore of the body and including an actuator housing including a blind link hole defining an opened rearward end, an actuator cap positioned over said opened end, a retaining ball protruding from a side of said actuator housing which engages into a corresponding slot in said longitudinal bore to retain said actuator housing in a cocked position, a slidable link positioned within said blind link hole, said slidable link including and arm connected thereto by means of a living hinge to engage said retaining ball and urge said slidable link forwardly, a fusible link interconnecting said actuator cap and said slidable link for retaining said slidable link rearwardly in a cocked position within said blind link hole, and means for fusing said fusible link upon being supplied electrical current thereto;

water-sensing circuit for sensing water and for supplying electrical current to said fusing means;

means for electrically connecting the battery to said water-sensing circuit for supplying electrical power thereto;

a firing pin operatively positioned within the longitudinal bore in alignment with the gas cartridge to pierce the same; and a high-compression spring for forcibly urging said fusible link actuator assembly toward said firing pin such that, upon fusing of said fusible link, said arm hinges along the length of said slidable link and said slidable link moves forwardly within said blind link hole, whereupon said retaining ball moves inwardly and disengage from said slot in said longitudinal bore, whereupon said actuator housing is urged forwardly by said high-compression spring in operative engagement with said firing pin, whereupon said firing pin pierces the gas cartridge.

20. The autoinflator as set forth in claim 19, further including a screw cap threadably engaged into said longitudinal bore with said high-compression spring being positioned between said screw cap and said fusible link actuator assembly, whereby upon removal of said screw cap, said fusible link actuator assembly may be removed.

21. The autoinflator as set forth in claim 20, further including means for connecting said high-compression spring to said screw cap.

22. The autoinflator as set forth in claim 20 further including means for connecting said high-compression spring to said actuator cap.

23. The autoinflator as set forth in claim 20, wherein said high-compression spring includes a length relative, to the distance between said %crew cap and said fusible link actuator assembly such that said screw cap may initially threadably engage said longitudinal bore without compression of said high-compression spring.

24. The autoinflator as set forth in claim 20, wherein said screw cap includes a surface including a slot permitting a tool to engage into said slot to facilitate threaded engagement of said screw cap into said longitudinal bore.

25. The autoinflator as set forth in claim 19, wherein said fusible link comprises a plastic bolt which threadably interconnects said actuator cap and said slidable link and wherein said fusing means comprises a heater wire encircling said bolt to fuse said bolt upon being supplied electrical current thereto.

26. The autoinflator as set forth in claim 19, wherein said actuator housing further includes an O-ring positioned about its circumference for sealing engagement with said longitudinal bore.

27. The autoinflator as set forth in claim 19, further including an ejector lever operatively positioned within said longitudinal bore for ejecting said fusible link actuator assembly.

28. The autoinflator as set forth in claim 19, wherein said ejector lever comprises a manual firing lever operatively positioned within said longitudinal bore for manually urging said firing pin forwardly to pierce the gas cartridge.

29. The autoinflator as set forth in claim 19, further including window means positioned relative to said longitudinal bore to visually indicate when said fusible link actuator assembly has been actuated.

30. The autoinflator as set forth in claim 19, further including a battery compartment cap positioned over an opened-end of said battery compartment with one side of said cap farthest from the gas cartridge being pivotably connected to said body and with another side of said cap adjacent to the gas cartridge including a releasable latch for releasable connection to said body, said latch including a slot allowing said latch to be opened with a tool when the gas cartridge is removed from said body.

31. The autoinflator as set forth in claim 19, wherein said water-sensing circuit comprises an activation timer for timing the duration of water immersion regardless of water conductivity, an activation timer reset for said activation timer to assure uniform water immersion timing regardless of previous water immersion history, and an activation duration timer for timing the duration of electrical current supplied to said fusing means.

32. The autoinflator as set forth in claim 19, further including at least one orientation arm extending from said slidable link that engages into a slot formed in said actuator housing to prevent rotation of said slidable link.

* * * * *

UNITED STATES PATENT AND TRADEMARK OFFICE

CERTIFICATE OF CORRECTION

PATENT NO. : 5,509,576

DATED : April 23, 1996

INVENTOR(S) : Jacek M. Weinheimer, Michael T. Taylor and Richard A. Boe

It is certified that error appears in the above—identified patent and that said Letters Patent is hereby corrected as shown below:

Column 22, line 12, after "angle", please insert "β".

Column 22, line 31, please delete "and" and insert therefor "an".

Column 23, line 6, please delete "%crew" and insert therefor "screw".

Signed and Sealed this

Seventeenth Day of September, 1996

*Attest:*

*Attesting Officer*

BRUCE LEHMAN

*Commissioner of Patents and Trademarks*